US010056056B2

(12) United States Patent
Nakanishi et al.

(10) Patent No.: US 10,056,056 B2
(45) Date of Patent: Aug. 21, 2018

(54) DISPLAY DEVICE

(71) Applicant: Japan Display Inc., Tokyo (JP)

(72) Inventors: Takayuki Nakanishi, Tokyo (JP); Tatsuya Yata, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/602,712

(22) Filed: May 23, 2017

(65) Prior Publication Data

US 2017/0256234 A1 Sep. 7, 2017

Related U.S. Application Data

(63) Continuation of application No. 14/802,153, filed on Jul. 17, 2015, now Pat. No. 9,685,137.

(30) Foreign Application Priority Data

Jul. 17, 2014 (JP) ..... 2014-147079

(51) Int. Cl.
*G09G 5/02* (2006.01)

(52) U.S. Cl.
CPC ..... *G09G 5/02* (2013.01); *G09G 2300/0452* (2013.01); *G09G 2320/0666* (2013.01); *G09G 2330/021* (2013.01); *G09G 2340/06* (2013.01)

(58) Field of Classification Search
CPC ... G02F 1/134336; G02F 2001/134345; G02F 2201/52; G09G 3/32; H01L 27/3218; H01L 27/3213; H01L 27/3216
See application file for complete search history.

(56) References Cited

U.S. PATENT DOCUMENTS 6,885,380 B1 4/2005 Primerano et al.
8,994,763 B2 * 3/2015 Miyake ..... G09G 3/32 345/694
9,122,065 B2 * 9/2015 Uehara ..... G02B 27/2214
2009/0309810 A1 * 12/2009 Chang ..... G02F 1/13336 345/1.3
2010/0053992 A1 * 3/2010 Krijn ..... G02B 6/0038 362/606
2011/0285714 A1 * 11/2011 Swic ..... G09G 5/02 345/428
2012/0242723 A1 9/2012 Miyake
(Continued)

FOREIGN PATENT DOCUMENTS

JP 2007-514184 A 5/2007

*Primary Examiner* — Abbas Abdulselam
(74) *Attorney, Agent, or Firm* — Michael Best & Friedrich LLP

(57) ABSTRACT

According to an aspect, a display device includes: an image display unit in which pixels are arranged, each of the pixels including a fourth sub-pixel and surrounding sub-pixels arranged around the fourth sub-pixel, the fourth sub-pixels of the respective pixels being arranged in a two-dimensional matrix and displaying a white color component as a fourth color, each of the pixels sharing at least one of the surrounding sub-pixels with an adjacent pixel adjacent to the pixel; and a signal processing unit that, based on a first input video signal for a specific pixel and a second input video signal for an adjacent pixel adjacent to the specific pixel, generates an output signal for the surrounding sub-pixels belonging to the specific pixel and outputs the generated output signal to the image display unit.

14 Claims, 15 Drawing Sheets

(56) References Cited

U.S. PATENT DOCUMENTS

| | | | | |
|---|---|---|---|---|
| 2014/0035971 | A1 | 2/2014 | Brown Elliott | |
| 2014/0184655 | A1 | 7/2014 | Jang et al. | |
| 2014/0204072 | A1* | 7/2014 | Yamaguchi ..... | G09G 3/3614 345/212 |

* cited by examiner

DISPLAY DEVICE

CROSS-REFERENCE TO RELATED APPLICATIONS

This application is a continuation application of application Ser. No. 14/802,153, filed Jul. 17, 2015 and claims priority to Japanese Application No. 2014-147079, filed on Jul. 17, 2014, the contents of which are incorporated by reference herein in their entirety.

BACKGROUND

1. Field of the Invention

The present disclosure relates to a display device.

2. Description of the Related Art

Display devices including an image display panel that lights self-light-emitting bodies such as organic light-emitting diodes (OLEDs) have been conventionally developed (refer to Published Japanese Translation of PCT International Application Publication No. 2007-514184, for example). This display device includes an image display panel that lights self-light-emitting bodies in which an additional primary color of a pixel W (white) is added to the three primary colors of pixels R (red), G (green), and B (blue). In this display device, backlighting is unnecessary, and power consumption of the display device is determined in accordance with lighting amounts of the self-light-emitting bodies of the respective pixels. When an input image with low hue is displayed on the image display panel, an input signal can be replaced with a color output signal of four colors containing the additional primary color W, and the power consumption of the display device can be reduced.

However, the conventional image display panel including the self-light-emitting bodies cannot use pixels of the additional primary color W when the hue of the input image is high and when the input image contains complementary colors, which may increase the power consumption of the display device. In this case, although the power consumption can be reduced by using an image display panel with complementary color pixels such as a pixel C (cyan), a pixel M (magenta), and a pixel Y (yellow) added, the number of pixels of the image display panel increases, and it is necessary to increase the density of pixel arrangement or decrease the resolution of the image display panel.

For the foregoing reasons, there is a need for a display device and an electronic apparatus that can suppress the power consumption and reduce the deterioration of an image quality.

SUMMARY

According to an aspect, a display device includes: an image display unit in which pixels are arranged, each of the pixels including a fourth sub-pixel and surrounding sub-pixels arranged around the fourth sub-pixel, the fourth sub-pixels of the respective pixels being arranged in a two-dimensional matrix and displaying a white color component as a fourth color, each of the pixels sharing at least one of the surrounding sub-pixels with an adjacent pixel adjacent to the pixel; and a signal processing unit that, based on a first input video signal for a specific pixel and a second input video signal for an adjacent pixel adjacent to the specific pixel, generates an output signal for the surrounding sub-pixels belonging to the specific pixel and outputs the generated output signal to the image display unit.

According to another aspect, a display device includes an image display unit in which pixels are arranged. Each of the pixels includes a fourth sub-pixel and eight surrounding sub-pixels arranged in a square grid shape of three rows and three columns, the surrounding sub-pixels being arranged around the fourth sub-pixel. The fourth sub-pixels of the respective pixels are arranged in a two-dimensional matrix and display a white component as a fourth color, and each of the pixels shares at least one of the surrounding sub-pixels with an adjacent pixel adjacent to the pixel.

According to another aspect, a display device includes an image display unit in which pixels are arranged. Each of the pixels includes a fourth sub-pixel and at least three surrounding sub-pixels arranged around the fourth sub-pixel and at positions distances from the fourth sub-pixel of which are substantially equal. The fourth sub-pixels of the respective pixels are arranged in a two-dimensional matrix and display a white component as a fourth color. Each of the pixels shares at least one of the surrounding sub-pixels with an adjacent pixel adjacent to the pixel.

DETAILED DESCRIPTION

The following describes embodiments of the present disclosure with reference to the attached drawings. The present disclosure is merely an example, and appropriate changes with the essence of the invention maintained that can be easily thought of by those skilled in the art are naturally included in the scope of the present invention. Although there are some cases in which widths, thicknesses, shapes, or the like of respective parts may be schematically represented compared with actual forms in order to describe the drawings more clearly, they are merely examples and do not limit the definition of the present invention. In the present specification and drawings, components similar to ones described earlier with respect to a drawing already described may be denoted by the same symbols, and detailed description thereof may be appropriately omitted.

First Embodiment

Figure 1:
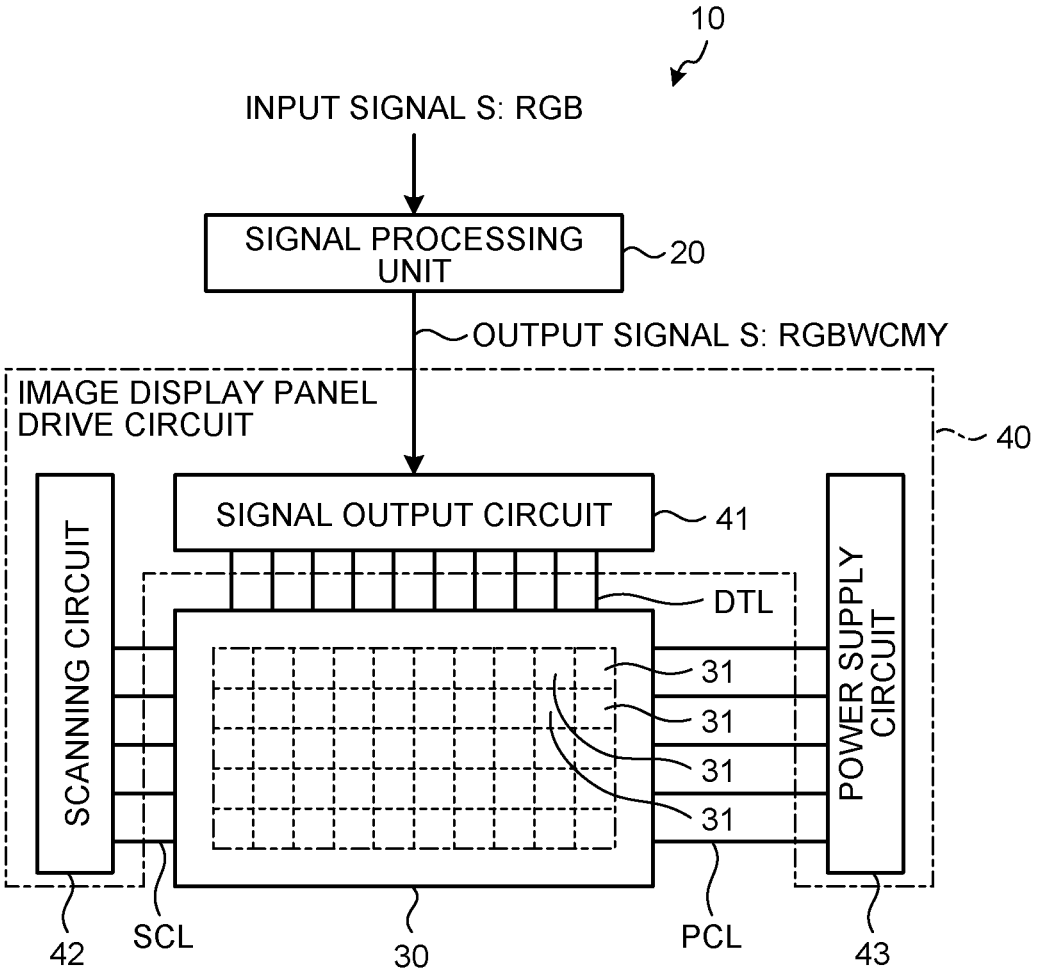
FIG. 1 is a block diagram illustrating an example of a configuration of a display device according to a first embodiment.

FIG. 1 is a block diagram illustrating an example of a configuration of a display device 10 according to a first embodiment. As illustrated in FIG. 1, the display device 10 includes a signal processing unit 20 that processes an input video signal (hereinafter, also referred to as an "input signal"), an image display unit 30 as an image display panel, and an image display panel drive circuit 40 (hereinafter, also referred to as a drive circuit 40) that controls the drive of the image display unit 30. The signal processing unit 20 may implement its functions by either hardware or software and is not particularly limited. Even when respective circuits of the signal processing unit 20 are configured by hardware, the respective circuits are not required to be physically independently distinguished from each other, and a plurality of pieces of functions may be implemented by a physically single circuit.

The signal processing unit 20 is coupled to the image display panel drive circuit 40 for driving the image display unit 30. The signal processing unit 20 converts an input image signal as first color information based on input values of an HSV (Hue-Saturation-Value, Value is also called Brightness) color space for displaying at a predetermined pixel determined based on the input video signal into reproduced values of the HSV color space reproduced by a first color, a second color, a third color, a fourth color, a fifth color, a sixth color, and a seventh color to generate an output signal. The signal processing unit 20 outputs the generated output signal to the image display panel drive circuit 40 of the image display unit 30.

The signal processing unit 20, based on the first color information in the input image signal, generates second color information in which part of a red (R) component, a green (G) component, and a blue (B) component is converted into an additional color component (a white (W) component, for example). The signal processing unit 20, based on the second color information, generates third color information in which part of the red (R) component, the green (G) component, and the blue (B) component contained in the second color information is converted into additional color components (a cyan (C) component, a magenta (M) component, and yellow (Y) component, for example). The signal processing unit 20 then outputs an output signal containing to drive circuit 40. The third color information is a seven-color color input signal (R, G, B, W, C, M, and Y). Although the additional color components are described, using respective 256 steps of gradation of the red (R) component, the green (G) component, and the blue (B) component, with the white component configured by (R, G, B)=(255, 255, 255), the cyan component configured by (R, G, B)=(0, 255, 255), the magenta component configured by (R, G, B)=(255, 0, 255), and the yellow component configured by (R, G, B)=(255, 255, 0) as examples, these are not limiting. Conversion to the additional color component may be performed such that a color component represented by, for example, (R, G, B)=(255, 230, 204) becomes the additional color component displayed by any one of a fourth sub-pixel to a seventh sub-pixel.

Although the present embodiment describes the conversion processing with processing that converts the input signal (RGB, for example) into a signal of the HSV space as an example as described above, this is not limiting, and an XYZ space, a YUV space, and other coordinate systems can be employed. Although a color gamut of sRGB or Adobe (registered trademark) RGB as a color gamut of a display is shown by a triangular range on an xy chromaticity range of an XYZ color system, a predetermined color space in which a definition color gamut is defined is not limited to be determined by a triangular range and may be determined by a range with any shape such as a polygonal shape.

The drive circuit 40 is a controller of the image display unit 30 and includes a signal output circuit 41, a scanning circuit 42, and a power supply circuit 43. The drive circuit 40 holds an output signal containing the second color information and successively outputs the output signal to respective pixels 31 of the image display unit 30 by the signal output circuit 41. The signal output circuit 41 is electrically coupled to the image display unit 30 via signal lines DTL. The drive circuit 40 selects a sub-pixel in the image display unit 30 and controls an on-off state of a switching element (a thin film transistor (TFT), for example) for controlling operation (light transmittance) of the sub-pixel by the scanning circuit 42. The scanning circuit 42 is electrically coupled to the image display unit 30 via scanning lines SCL. The power supply circuit 43 supplies electric power to a self-light-emitting body described below of the respective pixels 31 via power supply lines PCL.

Various modifications disclosed in Japanese Patent No. 3167026, Japanese Patent No. 3805150, Japanese Patent No. 4870358, Japanese Patent Application Laid-open Publication No. 2011-90118, and Japanese Patent Application Laid-open Publication No. 2006-3475 can be applied to the display device 10.

As illustrated in FIG. 1, in the image display unit 30, $P_0 \times Q_0$ ($P_0$ in a row direction and $Q_0$ in a column direction) pixels 31 are arranged in a two-dimensional matrix. Each of the pixels 31 includes a plurality of sub-pixels 32.

Figure 2:
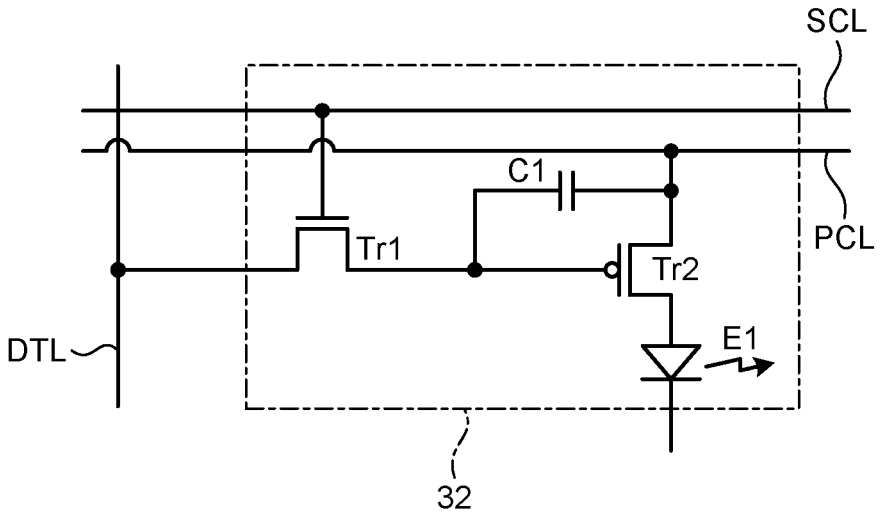
FIG. 2 is a diagram illustrating a lighting drive circuit of a sub-pixel included in a pixel of an image display unit according to the first embodiment.

FIG. 2 is a diagram illustrating a lighting drive circuit of a sub-pixel 32 included in the pixel 31 of the image display unit according to the first embodiment. As illustrated in FIG. 2, lighting drive circuits of the respective sub-pixels 32 are arranged in a two-dimensional matrix. The lighting drive circuit includes a transistor Tr1 for control, a transistor Tr2 for drive, and a capacitor C1 for charge retention. The gate of the transistor Tr1 for control is coupled to the scanning line SCL, the source thereof is coupled to the signal line DTL, and the drain thereof is coupled to the gate of the transistor Tr2 for drive. One end of the capacitor C1 for charge retention is coupled to the gate of the transistor Tr2 for drive, whereas the other end thereof is coupled to the source of the transistor Tr2 for drive. The source of the transistor Tr2 for drive is coupled to the power supply line PCL, whereas the drain of the transistor Tr2 for drive is coupled to the anode of an organic light-emitting diode E1 as the self-light-emitting body. The cathode of the organic light-emitting diode E1 is coupled to, for example, a reference potential (the ground, for example). Although FIG. 2 illustrates an example in which the transistor Tr1 for control is an n-channel type transistor, whereas the transistor Tr2 for drive is a p-channel type transistor, the polarities of the respective transistors are not so limited. The polarities of the transistor Tr1 for control and the transistor Tr2 for drive may be determined as needed.

Figure 3:
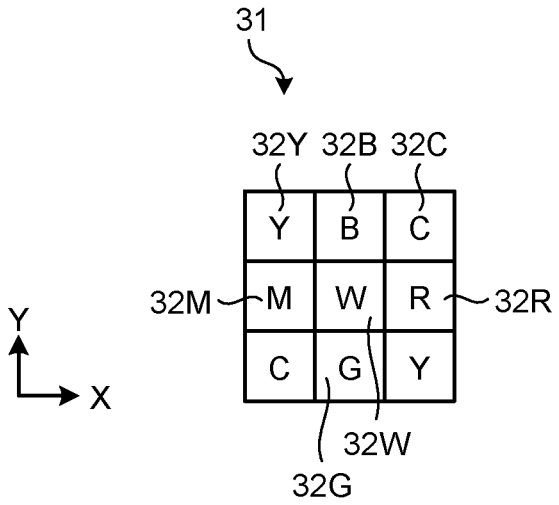
FIG. 3 is a diagram illustrating an arrangement of sub-pixels of the image display unit according to the first embodiment.

FIG. 3 is a diagram illustrating an arrangement of the sub-pixels 32 of the image display unit 30 according to the present embodiment. As illustrated in FIG. 3, the pixel 31 includes a first sub-pixel 32R displaying a first primary color (the red (R) component, for example), a second sub-pixel 32G displaying a second primary color (the green (G) component, for example), a third sub-pixel 32B displaying a third primary color (the blue (B) component, for example), a fourth sub-pixel 32W displaying a fourth color (white in the present embodiment) as an additional color component different from the first primary color, the second primary color, and the third primary color, a fifth sub-pixel 32C displaying a first complementary color (the cyan (C) component, for example) as the complementary color of the first primary color, a sixth sub-pixel 32M displaying a second complementary color (the magenta (M) component, for example) as the complementary color of the second primary color, and a seventh sub-pixel 32Y displaying a third complementary color (the yellow (Y) component, for example) as the complementary color of the third primary color. Below, when there is no need to distinguish the first sub-pixel 32R, the second sub-pixel 32G, the third sub-pixel 32B, the fourth sub-pixel 32W, the fifth sub-pixel 32C, the sixth sub-pixel 32M, and the seventh sub-pixel 32Y from each other, they will simply be called the sub-pixel 32.

In the pixel 31, nine sub-pixels 32 are arranged in a square grid shape of three rows and three columns, that is, three each in the row direction (X-axial direction) and in the column direction (Y-axial direction). The pixel 31 has the fourth sub-pixel 32W arranged at the center and the first sub-pixel 32R, the second sub-pixel 32G, the third sub-pixel 32B, the fifth sub-pixel 32C, the sixth sub-pixel 32M, and the seventh sub-pixel 32Y as surrounding sub-pixels arranged around the fourth sub-pixel 32W. In the pixel 31, two fifth sub-pixels 32C and two seventh sub-pixels 32Y are arranged at four corners. The two fifth sub-pixels 32C are arranged diagonally across the fourth sub-pixel 32W, whereas the two seventh sub-pixels 32Y are arranged diagonally across the fourth sub-pixel 32W. By thus arranging the two fifth sub-pixel 32C and the two seventh sub-pixel 32Y, which has higher luminance than the first sub-pixel 32R, the second sub-pixel 32G, the third sub-pixel 32B, and the sixth sub-pixel 32M, in each of the pixels 31, the luminance of the entire image displayed on the image display unit 30 increases.

Figure 4:
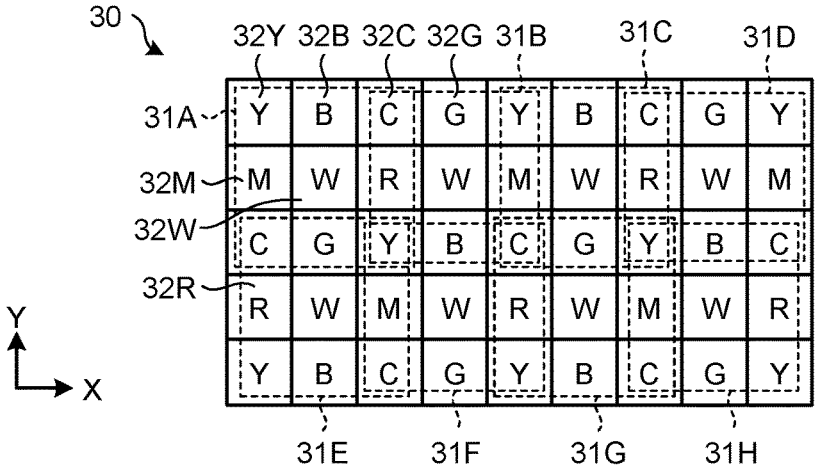
FIG. 4 is a diagram illustrating an arrangement of pixels of the image display unit according to the first embodiment.

FIG. 4 is a diagram illustrating an arrangement of the pixels 31 of the image display unit 30 according to the present embodiment. As illustrated in FIG. 4, in the image display unit 30, the fourth sub-pixels 32W belonging to the respective pixels 31 are arranged in a two-dimensional matrix in accordance with certain resolution. At least one sub-pixel 32 (a surrounding sub-pixel) among the first sub-pixel 32R, the second sub-pixel 32G, the third sub-pixel 32B, the fifth sub-pixel 32C, the sixth sub-pixel 32M, and the seventh sub-pixel 32Y arranged around the fourth sub-pixel 32W is arranged so as to be shared with an adjacent pixel 31.

In the example illustrated in FIG. 4, the fourth sub-pixel 32W belonging to a first pixel 31A, the fourth sub-pixel 32W belonging to a second pixel 31B, the fourth sub-pixel 32W belonging to a third pixel 31C, the fourth sub-pixel 32W belonging to a fourth pixel 31D, the fourth sub-pixel 32W belonging to a fifth pixel 31E, the fourth sub-pixel 32W belonging to a sixth pixel 31F, the fourth sub-pixel 32W belonging to a seventh pixel 31G, and the fourth sub-pixel 32W belonging to an eighth pixel 31H are arranged in a two-dimensional matrix in the row direction (X-axial direction) and the column direction (Y-axial direction) of the image display unit 30. A color pixel selected from the first sub-pixel 32R, the second sub-pixel 32G, the third sub-pixel 32B, the fifth sub-pixel 32C, the sixth sub-pixel 32M, and the seventh sub-pixel 32Y other than the fourth sub-pixel 32W is arranged at each end in the row direction. A color pixel selected from the first sub-pixel 32R, the second sub-pixel 32G, the third sub-pixel 32B, the fifth sub-pixel 32C, the sixth sub-pixel 32M, and the seventh sub-pixel 32Y other than the fourth sub-pixel 32W is arranged at each end in the column direction. In other words, in the image display unit 30, surrounding sub-pixels 32 are arranged at both ends in the row direction and the column direction, respectively.

The first pixel 31A shares the first sub-pixel 32R, the fifth sub-pixel 32C, and the seventh sub-pixel 32Y with the second pixel 31B as an adjacent pixel adjacent to the right side of the first pixel 31A. The first sub-pixel 32R, the fifth sub-pixel 32C, and the seventh sub-pixel 32Y arranged at the column next to the fourth sub-pixel 32W belonging to the first pixel 31A also belong to the second pixel 31B. The first pixel 31A shares the second sub-pixel 32G, the fifth sub-pixel 32C, and the seventh sub-pixel 32Y with the fifth pixel 31E adjacent to the lower side of the first pixel 31A. The second sub-pixel 32G, the fifth sub-pixel 32C, and the seventh sub-pixel 32Y arranged at the row next to the fourth sub-pixel 32W belonging to the first pixel 31A also belong to the fifth pixel 31E. Similarly, the second pixel 31B shares the fifth sub-pixel 32C, the sixth sub-pixel 32M, and the seventh sub-pixel 32Y with the third pixel 31C adjacent to the right side of the second pixel 31B. The second pixel 31B shares the third sub-pixel 32B, the fifth sub-pixel 32C, and the seventh sub-pixel 32Y with the sixth pixel 31F adjacent to the lower side of the second pixel 31B.

Similarly, the third pixel 31C shares the first sub-pixel 32R, the fifth sub-pixel 32C, and the seventh sub-pixel 32Y with the fourth pixel 31D adjacent to the right side of the third pixel 31C. The third pixel 31C shares the second sub-pixel 32G, the fifth sub-pixel 32C, and the seventh sub-pixel 32Y with the seventh pixel 31G adjacent to the lower side of the third pixel 31C. The fourth pixel 31D shares the third sub-pixel 32B, the fifth sub-pixel 32C, and the seventh sub-pixel 32Y with the eighth pixel 31H adjacent to the lower side of the fourth pixel 31D. The fifth pixel 31E shares the fifth sub-pixel 32C, the sixth sub-pixel 32M, and the seventh sub-pixel 32Y with the sixth pixel 31F adjacent to the right side of the fifth pixel 31E. The sixth pixel 31F shares the first sub-pixel 32R, the fifth sub-pixel 32C, and the seventh sub-pixel 32Y with the seventh pixel 31G adjacent to the right side of the sixth pixel 31F. The seventh pixel 31G shares the fifth sub-pixel 32C, the sixth sub-pixel 32M, and the seventh sub-pixel 32Y with the eighth pixel 31H adjacent to the right side of the seventh pixel 31G. Although the above embodiment describes an example in which the adjacent pixels 31 share three sub-pixels 32, the number of the sub-pixels 32 shared with the adjacent pixels 31 may be at least one.

Figure 5:
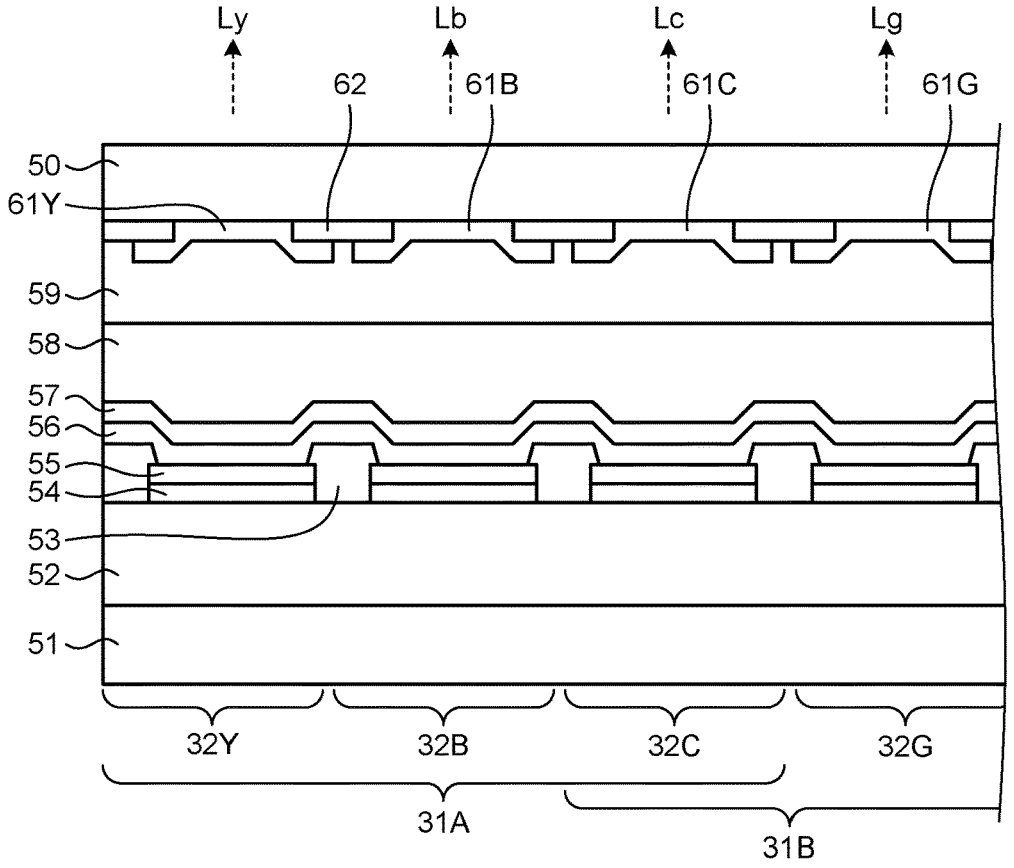
FIG. 5 is a diagram illustrating a sectional structure of the image display unit according to the first embodiment.

FIG. 5 is a diagram illustrating a sectional structure of the image display unit 30 according to the present embodiment. FIG. 5 illustrates a sectional structure of part of the first pixel 31A and the second pixel 31B illustrated in FIG. 4. As illustrated in FIG. 5, the image display unit 30 includes a substrate 51, insulating layers 52 and 53, reflective layers 54, lower electrodes 55, a self-light-emitting layer 56, an upper electrode 57, an insulating layer 58, an insulating layer 59, color filters 61Y, 61B, 61C, and 61G as color conversion layers, black matrixes 62 as light shielding layers, and a substrate 50. The substrate 51 is a semiconductor substrate such as silicon, a glass substrate, a resin substrate, or the like and forms or holds the lighting drive circuit and the like. The insulating layer 52 is a protective film for protecting the lighting drive circuit and the like and can be silicon oxide, silicon nitride, or the like. The respective lower electrodes 55 are provided for the seventh sub-pixel 32Y, the third sub-pixel 32B, the fifth sub-pixel 32C, and the second sub-pixel 32G and are electric conductors serving as the anode (positive pole) of the organic light-emitting diode E1. The lower electrodes 55 are translucent electrodes formed of a translucent electric conductive material (a translucent electric conductive oxide) such as indium tin oxide (ITO). The insulating layers 53 are called banks and partition the seventh sub-pixel 32Y, the third sub-pixel 32B, the fifth sub-pixel 32C, and the second sub-pixel 32G. The reflective layers 54 are formed of a material having a metallic luster that reflects light from the self-light-emitting layer 56 such as silver, aluminum, and gold. The self-light-emitting layer 56 contains organic materials and includes a hole injection layer, a hole transport layer, a light-emitting layer, an electron transport layer, and an electron injection layer, which are not illustrated.

Hole Transport Layer

Preferable examples of the hole transport layer that generates holes include a layer containing an aromatic amine compound and a substance showing electron accepting property to the compound. The aromatic amine compound is a substance having an arylamine skeleton. Among the aromatic amine compounds, a particularly preferable one contains triphenylamine as its skeleton and has a molecular weight of 400 or more. Among the aromatic amine compounds having triphenylamine as its skeleton, a particularly preferable one contains a fused aromatic ring such as a naphthyl group as its skeleton. Using the aromatic amine compound having triphenylamine and the fused aromatic ring as its skeleton increases the heat resistance of a light-emitting element. Specific examples of the aromatic amine compound include 4,4'-bis[N-(1-naphthyl)-N-phenylamino]biphenyl (α-NPD for short), 4,4'-bis[N-(3-methylphenyl)-N-phenylamino]biphenyl (TPD for short), 4,4',4"-tris(N,N-diphenylamino) triphenylamine (TDATA for short), 4,4',4"-tris[N-(3-methylphenyl)-N-phenylamino]triphenylamine (MTDATA for short), 4,4'-Bis[N-{4-(N,N-di-m-tolylamino) phenyl}-N-phenylamino]biphenyl (DNTPD for short), 1,3,5-tris[N,N-di(m-tolyl)amino]benzene (m-MTDAB for short), 4,4',4"-tris(N-carbazolyl)triphenylamine (TCTA for short), 2,3-bis(4-diphenylaminophenyl)quinoxaline (TPAQn for short), 2,2',3,3'-tetrakis(4-diphenylaminophenyl)-6,6'-bisquinoxaline (D-TriPhAQn for short), and 2,3-bis{4-[N-(1-naphthyl)-N-phenylamino]phenyl}-dibenzo[f,h]quinoxaline (NPADiBzQn for short). Examples of the substance having electron accepting property to the aromatic amine compound include, but not limited to, molybdenum oxides, vanadium oxides, 7,7,8,8,-tetracyanoquinodimethane (TCNQ for short), 2,3,5,6-tetrafluoro-7,7,8,8,-tetracyanoquinodimethane (F4-TCNQ for short).

Electron Injection Layer and Electron Transport Layer

Examples of an electron transport substance include, but not limited to, metal complexes such as tris(8-quinolinolato) aluminum (Alq3 for short), tris(4-methyl-8-quinolinolate) aluminum (Almq3 for short), bis(10-hydroxybenzo[h]-quinolinolato)beryllium (BeBq2 for short), bis(2-methyl-8-quinolinolate)-4-(phenylphenolato)aluminum (BAlq for short), bis[2-(2-hydroxyphenyl)benzoxazolato]zinc (Zn(BOX)2 for short), and bis[2-(2-hydroxyphenyl)benzothiazolato]zinc (Zn(BTZ)2 for short), 2-(4-biphenylyl)-5-(4-tert-butylphenyl)-1,3,4-oxadiazole (PBD for short), 1,3-bis(5-p-tert-butylphenyl)-1,3,4-oxadiazol-2-yl)benzene (OXD-7 for short), 3-(4-tert-butylphenyl)-4-phenyl-5-(4-biphenylyl)-1,2,4-triazole (TAZ for short), 3-(4-tert-butylphenyl)-4-(4-ethylphenyl)-5-(4-biphenylyl)-1,2,4-triazole (p-EtTAZ for short), bathophenanthroline (BPhen for short), and bathocuproin (BCP for short). Examples of a substance showing electron donating property to the electron transport substance include, but not limited to, alkali metals such as lithium and cesium, alkali earth metals such as magnesium and calcium, and rare earth metals such as erbium and ytterbium. Substances selected from alkali metal oxides and alkali earth metal oxides such as lithium oxide ($Li_2O$), calcium oxide (CaO), sodium oxide ($Na_2O$), potassium oxide ($K_2O$), and magnesium oxide (MgO) may also be used as the substance showing electron donating property to the electron transport substance.

Light-Emitting Layer

When red light emission is desired, for example, examples of a substance include substances that emit light having an emission spectral peak of 600 nm to 680 nm such as 4-dicyanomethylene-2-isopropyl-6-[2-(1,1,7,7-tetramethyljulolidin-9-yl)ethenyl]-4H-pyran (DCJTI for short), 4-dicyanomethylene-2-methyl-6-[2-(1,1,7,7-tetramethyljulolidin-9-yl)ethenyl]-4H-pyran (DCJT for short), 4-dicyanomethylene-2-tert-butyl-6-[2-(1,1,7,7-tetramethyljulolidin-9-yl)ethenyl]-4H-pyran (DCJTB for short), periflanthene, and 2,5-dicyano-1,4-bis[2-(10-methoxy-1,1,7,7-tetramethyljulolidin-9-yl)ethenyl]benzene. When green light emission is desired, examples of a substance include substances that emit light having an emission spectral peak of 500 nm to 550 nm such as N,N'-dimethylquinacridone (DMQd for short), coumarin 6, coumarin 545T, and tris(8-quinolinolato)aluminum (Alq3 for short). When blue light emission is desired, examples of a substance include substances that emit light having an emission spectral peak of 420 nm to 500 nm such as 9,10-bis(2-naphthyl)-tert-butylanthracene (t-BuDNA for short), 9,9'-bianthryl, 9,10-diphenylanthracene (DPA for short), 9,10-bis(2-naphthyl)anthracene (DNA for short), bis(2-methyl-8-quinolinolato)-4-phenylphenolato-gallium (BGaq for short), and bis(2-methyl-8-quinolinolato)-4-phenylphenolato-aluminum (BAlq for short). In addition to the substances that emit fluorescence as described above, substances that emit phosphorescence can also be used as a light-emitting substance such as bis[2-(3,5-bis(trifluoromethyl)phenyl)pyridinato-N,C2']iridium(III)picolinate (Ir(CF3ppy)2(pic) for short), bis[2-(4,6-difluorophenyl)pyridinato-N,C2']iridium(III)acetylacetonate (FIr(acac) for short), bis[2-(4,6-difluorophenyl)pyridinato-N,C2']iridium(III) picolinate (FIr(pic) for short), and tris(2-phenylpyridinato-N,C2')iridium (Ir(ppy)3 for short).

The upper electrode 57 is a translucent electrode formed of a translucent electric conductive material (a translucent electric conductive oxide) such an ITO. Although the present embodiment exemplifies ITO as an example of the translucent electric conductive material, this is not limiting. The translucent electric conductive material may be an electric conductive material having a different composition such as indium zinc oxide (IZO). The upper electrode 57 serves as the cathode (negative pole) of the organic light-emitting diode E1. The insulating layer 58 is a sealing layer for sealing the upper electrode and can be silicon oxide, silicon nitride, or the like. The insulating layer 59 is a flattening layer for reducing unevenness caused by the banks and can be silicon oxide, silicon nitride, or the like. The substrate 50 is a translucent substrate for protecting the entire image display unit 30 and can be, for example, a glass substrate. Although FIG. 5 illustrates an example in which the lower electrodes 55 are the anodes (positive poles), whereas the upper electrode 57 is the cathode (negative electrode), this is not limiting. The lower electrodes 55 may be the cathodes, whereas the upper electrode 57 may be the anode; in this case, the polarity of the transistor Tr2 for drive electrically coupled to the lower electrodes 55 can appropriately be changed. The stacking order of carrier injection layers (the hole injection layer and the electron injection layer), carrier transport layers (the hole transport layer and the electron transport layer), and the light-emitting layer can appropriately be changed.

The image display unit 30 is a color display panel. In the image display unit 30, a seventh color filter 61Y is arranged between the seventh sub-pixel 32Y and an image viewer. The seventh color filter 61Y causes third complementary color light Ly among light emission components of the self-light-emitting layer 56 to pass therethrough. Similarly, in the image display unit 30, a third color filter 61B is arranged between the third sub-pixel 32B and the image viewer. The third color filter 61B causes third primary light Lb among the light emission components of the self-light-emitting layer 56 to pass therethrough. Similarly, the image display unit 30, a fifth color filter 61C is arranged between the fifth sub-pixel 32C and the image viewer. The fifth color filter 61C causes first complementary light Lc among the light emission components of the self-light-emitting layer 56 to pass therethrough. Similarly, in the image display unit 30, a second color filter 61G is arranged between the second sub-pixel 32G and the image viewer. The second color filter 61G causes a light emission component adjusted so as to be second primary light Lg among the light emission components of the self-light-emitting layer 56 to pass therethrough. Although not illustrated in FIG. 5, in the image display unit 30, a first color filter 61R is arranged between the first sub-pixel 32R and the image viewer. The first color filter 61R causes first primary color Lr among the light emission components of the self-light-emitting layer 56 to pass therethrough. Similarly, in the image display unit 30, a fourth color filter 61W is arranged between the fourth sub-pixel 32W and the image viewer. The fourth color filter 61W causes fourth primary light Lw among the light emission components of the self-light-emitting layer 56 to pass therethrough. Similarly, in the image display unit 30, a sixth color filter 61M is arranged between the sixth sub-pixel 32M and the image viewer. The sixth color filter 61M causes second complementary light Lm among the light emission components of the self-light-emitting layer 56 to pass therethrough.

The image display unit 30 can emit the fourth primary light Lw having a color component different from those of the first primary color Lr, the second primary color Lg, and the third primary light Lb from the fourth sub-pixel 32W. No color filter may be arranged between the fourth sub-pixel 32W and the image viewer. The image display unit 30 can also emit the fourth primary light Lw having the color component different from those of the first primary color Lr, the second primary color Lg, and the third primary light Lb from the fourth sub-pixel 32W without color conversion layers such as color filters for the light emission components of the self-light-emitting layer 56. The image display unit 30, for example, may be provided with a transparent resin layer in place of the fourth color filter 61W for color adjustment for the fourth sub-pixel 32W. By thus providing the transparent resin layer, the image display unit 30 can prevent the occurrence of a large gap above the fourth sub-pixel 32W, otherwise a large gap occurs because no filter is provided for the fourth sub-pixel 32W.

Figure 6:
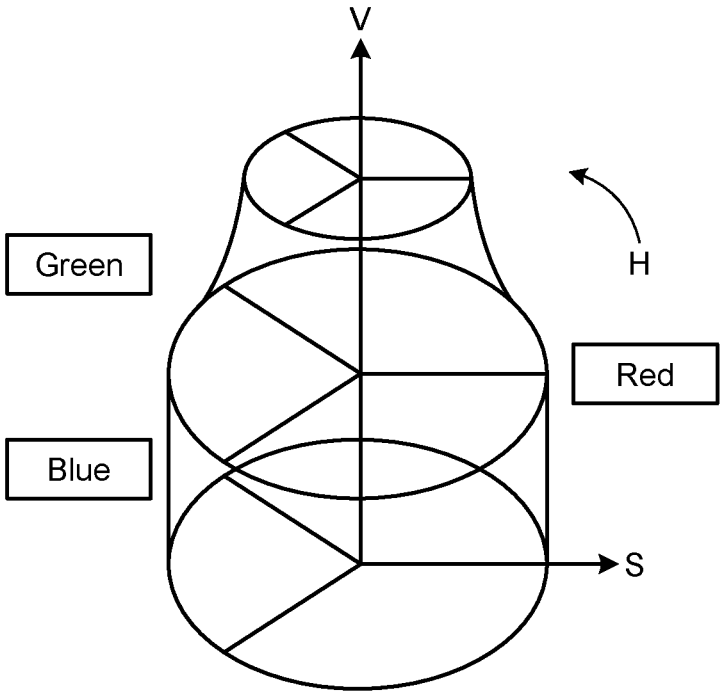
FIG. 6 is a conceptual diagram of an HSV color space reproducible by the display device according to the first embodiment.
Figure 7:
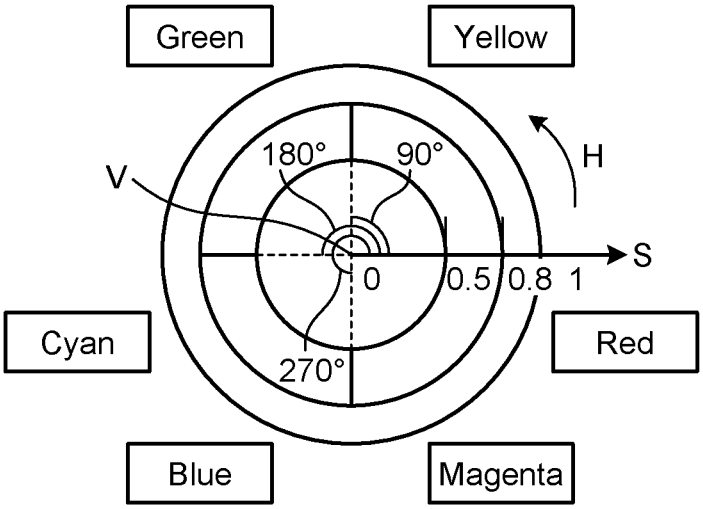
FIG. 7 is a conceptual diagram illustrating a relation between hue and saturation in an HSV color space.

FIG. 6 is a conceptual diagram of the HSV color space reproducible by the display device according to the present embodiment. FIG. 7 is a conceptual diagram illustrating a relation between hue and saturation of the HSV color space. The display device 10 includes the fourth sub-pixel 32W outputting the fourth color (white) in the pixel 31, thereby enabling the dynamic range of brightness in the HSV space to be widened as illustrated in FIG. 6. In other words, as illustrated in FIG. 6, a substantially truncated cone in which the maximum value of brightness V decreases as saturation S increases is placed on a cylindrical HSV color space that the first sub-pixel 32R, the second sub-pixel 32G, and the third sub-pixel 32B can display.

The input image signal contains the input signal with respective steps of gradation of the red (R) component, the green (G) component, and the blue (B) component as the first color information and indicates information on the cylindrical shape of the HSV color space, that is, the cylindrical part of the HSV color space illustrated in FIG. 6. As illustrated in FIG. 7, hue H is represented by from 0° to 360°. From 0° toward 360°, Red, Yellow, Green, Cyan, Blue, Magenta, and Red are arranged. In the present embodiment, an area containing an angle of 0° is red, an area containing an angle of 120° is green, and an area containing an angle of 240° is blue.

The present embodiment replaces part of the red (R) component, the green (G) component, and the blue (B) component with the white (W) component to be output. This white component has higher luminance or higher power efficiency to display color components than a case in which the white component is represented by the red component, the green component, and the blue component. In other words, when the output of the white component and the output of the red component, the green component, and the blue component are equal in power consumption, outputting by the white component gives higher luminance than outputting by the red component, the green component, and the blue component. When the output of the white component and the output of the red component, the green component, and the blue component are equal in luminance, outputting by the white component gives lower power consumption than outputting by the red component, the green component, and the blue component. As described above, smaller saturation gives a color closer to white, and in an area with small saturation, a ratio that can be replaced with the white component increases, thus power consumption can be reduced. For this reason, in the present embodiment, even when a luminance attenuation rate decreases as saturation decreases, the ratio that can be replaced with the white component increases, and power consumption can favorably be reduced.

The present embodiment replaces part of the red (R) component, the green (G) component, and the blue (B) component with the cyan (C) component and the yellow (Y) component to be output. These cyan component and yellow component has higher luminance or higher power efficiency to display color components than a case in which these cyan component and yellow component are represented by the red component, the green component, and the blue component. In other words, when the output of the cyan component and the yellow component and the output of the red component, the green component, and the blue component are equal in power consumption, outputting by the cyan component and the yellow component gives higher luminance than outputting by the red component, the green component, and the blue component. When the output of the cyan component and the yellow component and the output of the red component, the green component, and the blue component are equal in luminance, outputting by the cyan component and the yellow component gives lower power consumption than outputting by the red component, the green component, and the blue component. As described above, smaller saturation gives a color closer to white, and in an area with small saturation, a ratio that can be replaced with the cyan component and the yellow component increases, thus power consumption can be reduced. For this reason, in the present embodiment, even when a luminance attenuation rate decreases as saturation decreases, the ratio that can be replaced with the cyan component and the yellow component increases, and power consumption can favorably be reduced. The following describes a method for processing an image according to the present embodiment.

Figure 8:
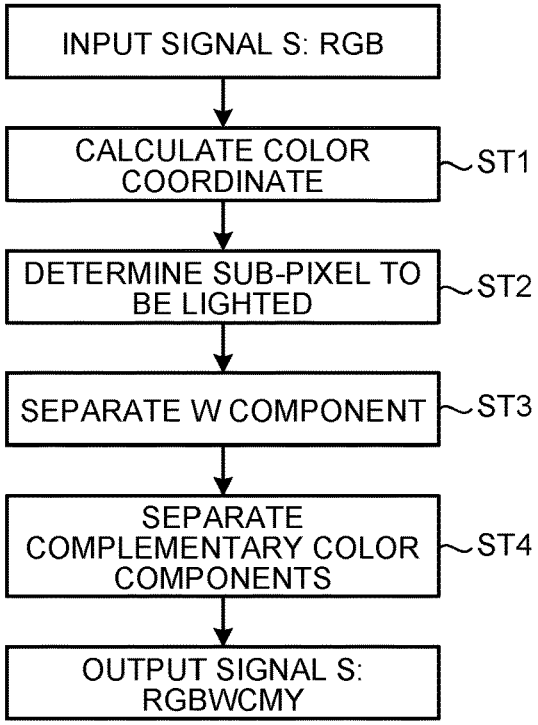
FIG. 8 is a flowchart of a method for processing an image according to the first embodiment.

FIG. 8 is a flowchart of the method for processing an image according to the present embodiment. As illustrated in FIG. 8, the signal processing unit 20 calculates a color coordinate based on the first color information of the input image signal (Step ST1) and determines the sub-pixel 32 to be lighted based on the calculated color coordinate (Step ST2). The signal processing unit 20 then separates the white (W) component from the color components (red (R), green (G), and blue (B)) contained in the first color information of the input image signal to generate the second color information and determines a lighting amount of the fourth sub-pixel 32W (Step ST3). The signal processing unit 20 then separates the first complementary color (C) component, the second complementary color (M) component, and the third complementary color (Y) component from the color components (red (R), green (G), and blue (B)) contained in the second color information to generate the third color information and determines lighting amounts of the sub-pixels 32 arranged around the fourth sub-pixels 32W of the respective pixels 31 (Step ST4). The signal processing unit 20 then generates an output signal based on the third color information and outputs the generated output signal to the image display unit 30. The following describes the respective steps ST1 through ST4 in detail.

Figure 9:
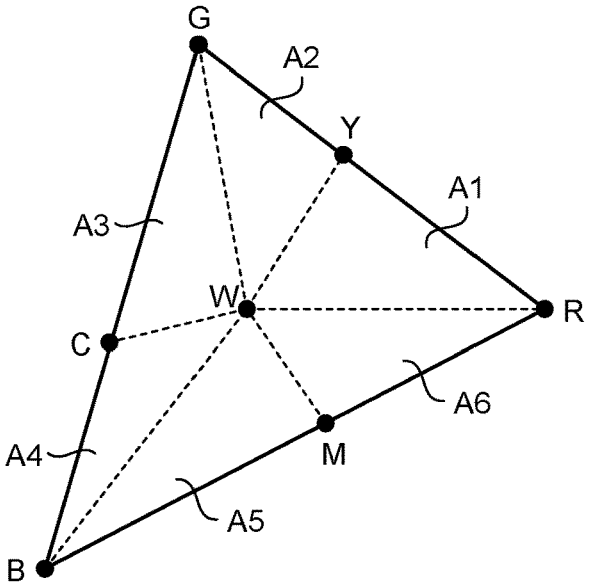
FIG. 9 is an explanatory diagram of color coordinate calculation according to the first embodiment.
Figure 10A:
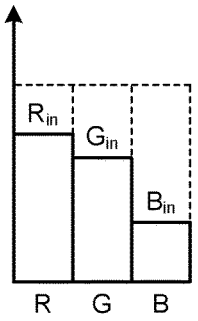
FIG. 10A is an explanatory diagram of color conversion according to the first embodiment.
Figure 10B:
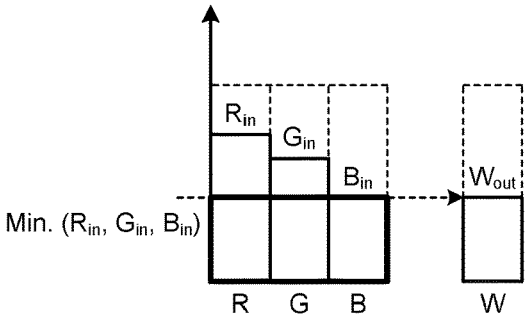
FIG. 10B is an explanatory diagram of the color conversion according to the first embodiment.
Figure 10C:
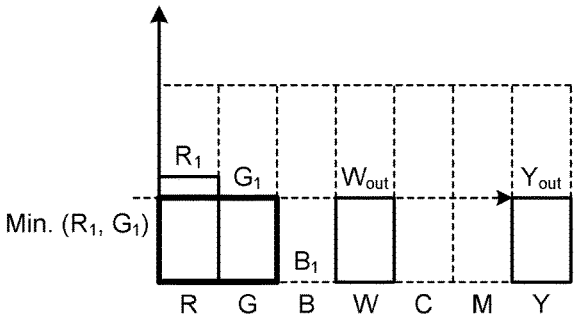
FIG. 10C is an explanatory diagram of the color conversion according to the first embodiment.
Figure 10D:
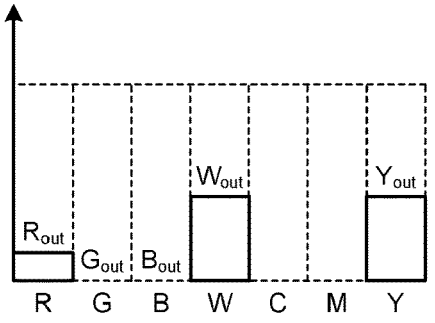
FIG. 10D is an explanatory diagram of the color conversion according to the first embodiment.

FIG. 9 is an explanatory diagram of color coordinate calculation according to the present embodiment. As illustrated in FIG. 9, in the present embodiment, the signal processing unit 20 performs calculation for the first color information contained in the input image signal using a color coordinate of a triangular area with red (R), green (G), and blue (B) as apexes. In this color coordinate, white (W) is at the center, yellow (y) is between red (R) and green (G), cyan (C) is between green (G) and blue (B), and magenta (M) is between blue (B) and red (R). The signal processing unit 20 divides this color coordinate into a first quadrant A1, a second quadrant A2, a third quadrant A3, a fourth quadrant A4, a fifth quadrant A5, and a sixth quadrant A6. The first quadrant A1 is an area with white (W), red (R), and yellow (Y) as apexes. The second quadrant A2 is an area with white (W), yellow (Y), and green (G) as apexes. The third quadrant A3 is an area with white (W), green (G), and cyan (C) as apexes. The fourth quadrant A4 is an area with white (W), cyan (C), and blue (B) as apexes. The fifth quadrant A5 is an area with white (W), blue (B), and magenta (M) as apexes. The sixth quadrant A6 is an area with white (W), magenta (M), and red (R) as apexes. The signal processing unit 20 calculates a color coordinate to which the color gamut of the first color information contained in the input image signal belongs corresponds to which of the first quadrant A1, the second quadrant A2, the third quadrant A3, the fourth quadrant A4, the fifth quadrant A5, and the sixth quadrant A6, thereby determining the sub-pixels 32 to be lighted in the respective pixels 31. In the example illustrated in FIG. 9, for example, when the color coordinate to which the first color information belongs corresponds to the first quadrant A1, the signal processing unit 20 lights the first sub-pixels 32R, the fourth sub-pixels 32W, and the seventh sub-pixels 32Y of the respective pixels 31, thereby enabling the color of the first color information contained in the input image signal to be reproduced.

FIG. 10A through FIG. 10D are explanatory diagrams of color conversion according to the present embodiment. As illustrated in FIG. 10A through FIG. 10D, the signal processing unit 20 determines the sub-pixels 32 to be lighted among the sub-pixels 32 belonging to the respective pixels 31 by the color coordinate calculation and then separates as color information on a white component ($W_{out}$) based on color information (Min. ($R_{in}$, $G_{in}$, $B_{in}$)) corresponding to the minimum value of the first color information (red ($R_{in}$), green ($G_{in}$), blue ($B_{in}$)) contained in the input image signal to generate the second color information. Consequently, in the example illustrated in FIG. 10A and FIG. 10B, part of the red (R) component, part of the green (G) component, and the blue (B) component become the white (W) component, and the red (R) component, the green (G) component, and the white (W) component remain. The signal processing unit 20 then separates a yellow (Y) component ($Y_{out}$) as a complementary color component based on color information (Min. ($R_1$, $G_1$)) corresponding to the minimum value of the second color information (red ($R_1$) and green ($G_1$)) from which the white component is separated to generate the third color information ($R_{out}$, $G_{out}$, $B_{out}$, $W_{out}$, $Y_{out}$). Consequently, in the example illustrated in FIG. 10C and FIG. 10D, part of the red (R) component and the green (G) component become the yellow (Y) component, and the red (R) component, the white (W) component, and the yellow (Y) component remain. Although the above embodiment describes an example in which all the green (G) component and the blue (B) component are converted into the white (W) component and the yellow (Y) component, it is not necessarily required to convert all the green (G) component and the blue (B) component. Although the above embodiment describes an example in which the complementary color component is separated from the second color information to generate the third color information, the signal processing unit 20 may generate the third color information by separating a primary color component from the second color information.

Figure 11A:
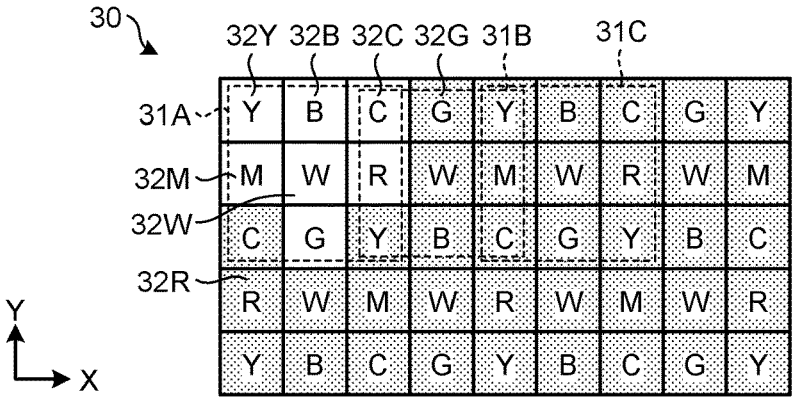
FIG. 11A is an explanatory diagram of an example of the image display unit according to the first embodiment.
Figure 11B:
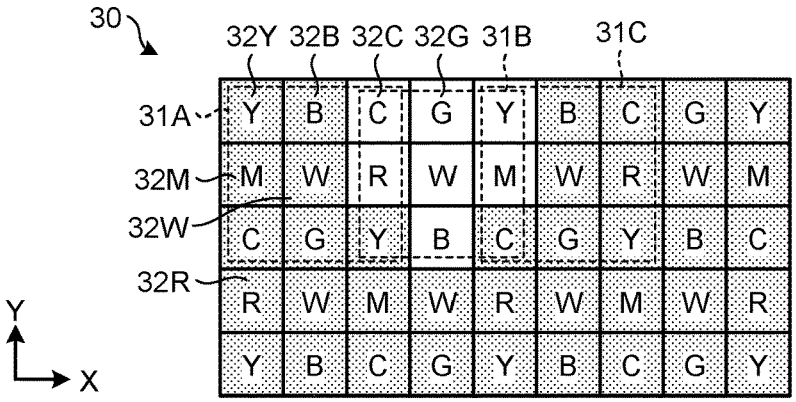
FIG. 11B is an explanatory diagram of an example of the image display unit according to the first embodiment.
Figure 11C:
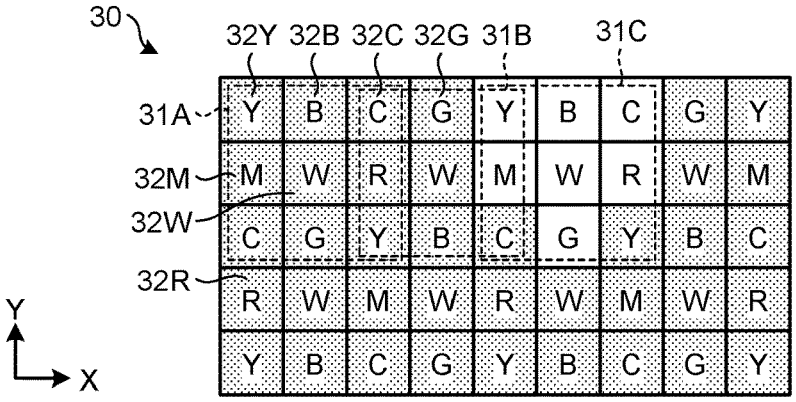
FIG. 11C is an explanatory diagram of an example of the image display unit according to the first embodiment.

FIG. 11A through FIG. 11C are explanatory diagrams of an example of the image display unit 30 according to the present embodiment. FIG. 11A through FIG. 11C illustrate an example in which the first sub-pixel 32R, the second sub-pixel 32G, the third sub-pixel 32B, the fourth sub-pixel 32W, the fifth sub-pixel 32C, the sixth sub-pixel 32M, and the seventh sub-pixel 32Y among nine sub-pixels 32 belonging to each of the first pixel 31A through the third pixel 31C are used as display pixels.

As illustrated in FIG. 11A through FIG. 11C, the signal processing unit 20, based on a first input image signal to be supplied to a specific pixel 31 and a second input image signal for an adjacent pixel 31 adjacent to the specific pixel 31, generates an output signal for lighting the surrounding sub-pixels 32 belonging to the specific pixel and outputs the generated output signal to the image display panel (the image display unit 30). In the example illustrated in FIG. 11A through FIG. 11C, the signal processing unit 20 first performs the color coordinate calculation and the color conversion on the first input image signal for the first pixel 31A and then determines lighting amounts of one fourth sub-pixel 32W belonging to the first pixel 31A and six surrounding sub-pixels 32 arranged around the one fourth sub-pixel 32W.

The signal processing unit 20 then performs the color coordinate calculation and the color conversion on the second input image signal for the second pixel 31B and determines lighting amounts of one fourth sub-pixel 32W belonging to the second pixel 31B and six surrounding sub-pixels 32 arranged around the one fourth sub-pixel 32W. The signal processing unit 20, for the first sub-pixel 32R and the fifth sub-pixel 32C shared with the first pixel 31A and the second pixel 31B, adds a lighting amount determined by the third color information based on the second input image signal for the second pixel 31B to a lighting amount determined by the third color information based on the first input image signal for the first pixel 31A to correct the lighting amounts of the first sub-pixel 32R and the fifth sub-pixel 32C. The signal processing unit 20 then outputs an output signal for the first pixel 31A according to the determined lighting amounts of the sub-pixels 32 to the image display unit 30.

The signal processing unit 20 then performs the color coordinate calculation and the color conversion on a third input image signal for the third pixel 31C and determines lighting amounts of one fourth sub-pixel 32W belonging to the third pixel 31C and six surrounding sub-pixels 32 arranged around the one fourth sub-pixel 32W. For the sixth sub-pixel 32M and the seventh sub-pixel 32Y shared with the second pixel 31B and the third pixel 31C, a lighting amount determined by the third color information for the third pixel 31C is added to a lighting amount determined by the second input image signal for the second pixel 31B to correct the lighting amounts of the sixth sub-pixel 32M and the seventh sub-pixel 32Y. The signal processing unit 20 then outputs an output signal for the second pixel 31B according to the determined lighting amounts of the sub-pixels 32 to the image display unit 30. The signal processing unit 20 then in a similar manner determines respective lighting amounts of the sub-pixels 32 belonging to the respective pixels 31 and then outputs output signals according to the determined lighting amounts to the image display unit 30.

In other words, in the present embodiment, for the sub-pixel 32 shared with the first pixel 31A and the second pixel 31B that are adjacent to each other, the lighting amount thereof is determined by the first input image signal that determines the lighting amount of the sub-pixel 32 belonging to the first pixel 31A and the second input image signal that determines the lighting amount of the sub-pixel 32 belonging to the second pixel 31B. For the sub-pixel 32 shared with the second pixel 31B and the third pixel 31C that are adjacent to each other, the lighting amount thereof is determined by the first input image signal that determines the lighting amount of the sub-pixel 32 belonging to the second pixel 31B and the second input image signal that determines the lighting amount of the sub-pixel 32 belonging to the third pixel 31C. With this configuration, even when the fourth sub-pixels 32W of the respective pixels 31 are arranged in a two-dimensional matrix in accordance with desired resolution, and the sub-pixels 32 other than the fourth sub-pixels 32W are arranged with half the desired resolution, colors according to the input image signal can be reproduced. Although the above embodiment describes an example in which the lighting amount of the sub-pixel 32 shared with the first pixel 31A and the second pixel 31B is determined by the addition of the first input image signal and the second input image signal, it may be determined by, for example, setting a certain ratio between the lighting amount by the first input image signal and the lighting amount of the second input image signal. With this configuration, the lighting amount can flexibly be set in accordance with the input image, and image quality can further be increased.

Figure 12A:
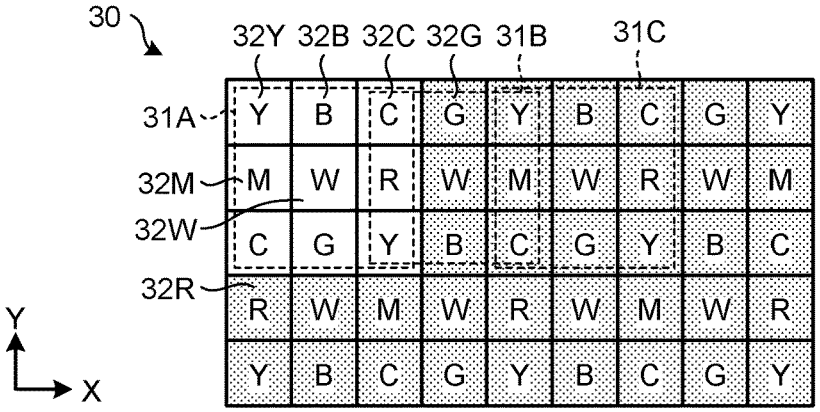
FIG. 12A is an explanatory diagram of an example of the image display unit according to the first embodiment.
Figure 12B:
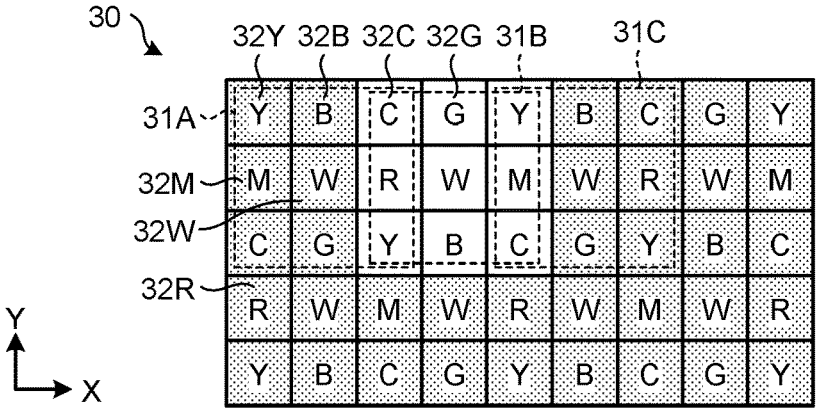
FIG. 12B is an explanatory diagram of an example of the image display unit according to the first embodiment.
Figure 12C:
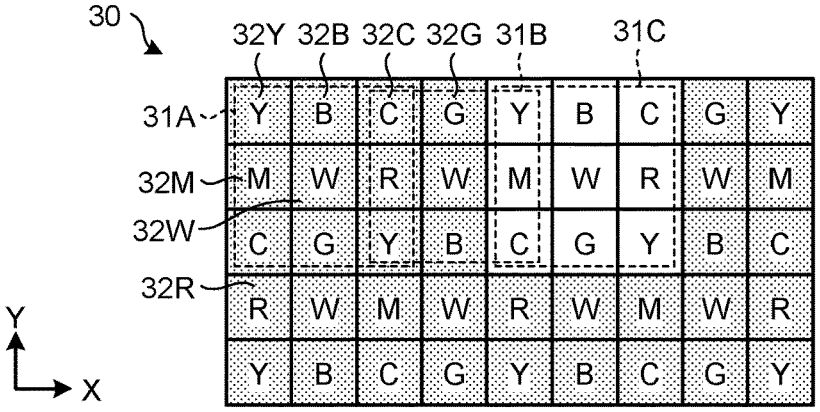
FIG. 12C is an explanatory diagram of an example of the image display unit according to the first embodiment.

FIG. 12A through FIG. 12C are explanatory diagrams of an example of the image display unit 30 according to the present embodiment. FIG. 12A through FIG. 12C illustrate an example of using all the nine sub-pixels 32 belonging to each of the first pixel 31A through the third pixel 31C. In the example illustrated in FIG. 12A through FIG. 12C, each of the pixels 31 includes two fifth sub-pixels 32C and two seventh sub-pixels 32Y, which has higher luminance than the first sub-pixel 32R, the second sub-pixel 32G, the third sub-pixel 32B, and the sixth sub-pixel 32M. The signal processing unit 20 lights the two fifth sub-pixels 32C such that each of the lighting amounts of the two fifth sub-pixels 32C becomes half the lighting amount assigned to the fifth sub-pixel 32C. The signal processing unit 20 lights the two seventh sub-pixels 32Y such that each of the lighting amounts of the two seventh sub-pixels 32Y becomes half the lighting amount assigned to the seventh sub-pixel 32Y. With this configuration, the lighting amounts of the high-luminance fifth sub-pixels 32C and seventh sub-pixels 32Y arranged at four corners of each of the pixels 31 are half the example illustrated in FIG. 11A through FIG. 11C. Therefore, even when the input image includes a boundary area where a high-luminance area with high luminance is adjacent to a low-luminance area with luminance lower than that of the high-luminance area, deterioration of image quality based on deviation of the center of gravity of luminance by pixel arrangement can be reduced. Although the above embodiment describes an example in which the lighting amount is ½, this configuration is not limiting. The lighting amount may be any lighting amount other than ½ in accordance with an image to be displayed, or may be set freely in connection with the lighting amounts of adjacent pixels.

As described above, the present embodiment arranges the fourth sub-pixels 32W of the white component in a two-dimensional matrix in accordance with desired resolution. Therefore, even when the sub-pixels 32 other than the fourth sub-pixels 32W are arranged with half the desired resolution, colors according to the input image signal can be reproduced, and deterioration of image quality can be reduced. Part of the red (R) component, the green (G) component, and the blue (B) component is successively replaced with the white (W) component, the cyan (C) component, and the yellow (Y) component to be output. Therefore, even when a luminance attenuation rate decreases as saturation decreases, the ratio that can be replaced with the white component increases, and power consumption can favorably be reduced.

In the present embodiment, for each of the pixels 31, the lighting amounts of the respective sub-pixels 32 are calculated in the condition that the fourth sub-pixel 32W as the white component is surrounded with the other surrounding sub-pixels 32, and that the surrounding sub-pixels 32 of each pixel 31 are shared with the adjacent pixel 31. In this regard, in FIG. 4, for example, in terms of the number of the sub-pixels 32 in the row direction in the upper two rows, if the column of the surrounding sub-pixels 32 positioned at the rightmost is not counted in, the numbers of the respective surrounding sub-pixels 32 of the respective pixels 31 are equal. By additionally providing the column of the surrounding sub-pixels 32 positioned at the rightmost, the number of the sub-pixels 32 of the pixel 31 at the rightmost increases, but the lighting of the above sub-pixels 32 can be achieved. The same applies to a case when viewed in the column direction. When viewed in the column direction, if the row of the surrounding sub-pixels 32 positioned at the lower side is not counted in, the numbers of the respective surrounding sub-pixels 32 of the respective pixels 31 are equal. By additionally providing the row of the surrounding sub-pixels 32 positioned at the lower side, the number of the sub-pixels 32 of the pixel 31 at the lower side increases, but the lighting of the above sub-pixels 32 can be achieved. In view of that point, it can be regarded that, in the present embodiment, when one end in the row direction of the image display unit 30 is defined as a basal end side, whereas the other end is defined as a terminal end, the pixel column positioned at the most basal end side includes the surrounding sub-pixels 32 other than the white component, the pixel column positioned at the most terminal end side also includes the surrounding sub-pixels 32 other than the white component, and the pixel column at the terminal end side is additionally provided. Similarly, it can be regarded that when one end in the column direction of the image display unit 30 is defined as a basal end side, whereas the other end is defined as a terminal end, the pixel row positioned at the most basal end side includes the surrounding sub-pixels 32 other than the white component, the pixel row positioned at the most terminal end side also includes the surrounding sub-pixels 32 other than the white component, and the pixel row at the terminal end side is additionally provided.

Second Embodiment

The following describes a second embodiment of the present disclosure. The following mainly describes points of difference from the first embodiment to avoid a duplicated description. Components common to those of the first embodiment are denoted by the same symbols.

Figure 13:
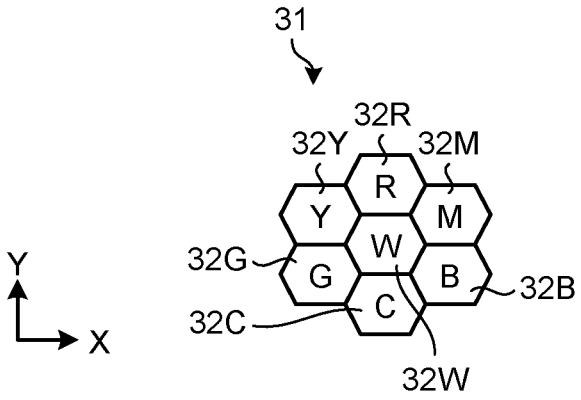
FIG. 13 is a diagram illustrating an arrangement of the sub-pixels in the image display unit according to the first embodiment.

FIG. 13 is a diagram illustrating an arrangement of the sub-pixels 32 in the image display unit 30 according to the present embodiment. As illustrated in FIG. 13, the pixels 31 each having the fourth sub-pixel 32W and at least three surrounding sub-pixels 32 are arranged in this image display unit 30. The fourth sub-pixels 32W of the respective pixels 31 display the white component as the fourth color and are arranged in a two dimensional matrix. The at least three surrounding sub-pixels 32 are arranged at positions the distances from the corresponding fourth sub-pixel 32W of which are substantially equal with the fourth sub-pixel 32W arranged at the center. Each pixel 31 shares at least one surrounding sub-pixel 32 with the adjacent pixel 31. In the present embodiment, the pixel 31 has seven sub-pixels with a substantially hexagonal shape in a plan view. In the pixel 31, the first sub-pixel 32R is arranged on the upper side of the fourth sub-pixel 32W, the second sub-pixel 32G and the seventh sub-pixel 32Y are arranged on the left side of the fourth sub-pixel 32W, the third sub-pixel 32B and the sixth sub-pixel 32M are arranged on the right side of the fourth sub-pixel 32W, and the fifth sub-pixel 32C is arranged on the lower side of the fourth sub-pixel 32W. In other words, in the pixel 31, the surrounding sub-pixels 32 are arranged in a hexagonal grid shape with the fourth sub-pixel 32W arranged at the center. Although the example illustrated in FIG. 13 describes an example of the six surrounding sub-pixels 32, the number of the surrounding sub-pixels 32 may be, for example, three.

Figure 14A:
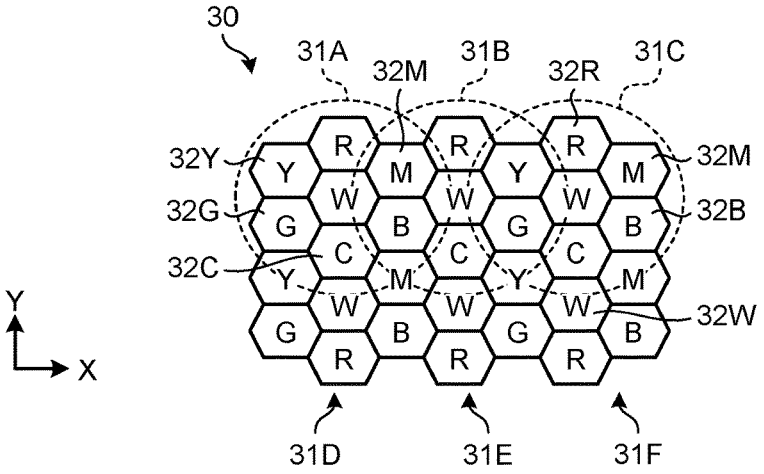
FIG. 14A is a diagram illustrating an arrangement of the sub-pixels in the image display unit according to a second embodiment.
Figure 14B:
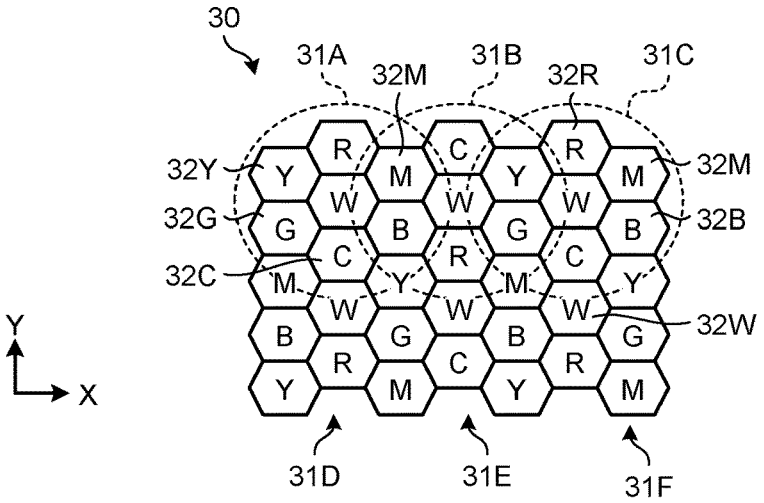
FIG. 14B is a diagram illustrating an arrangement of the sub-pixels in the image display unit according to the second embodiment.
Figure 14C:
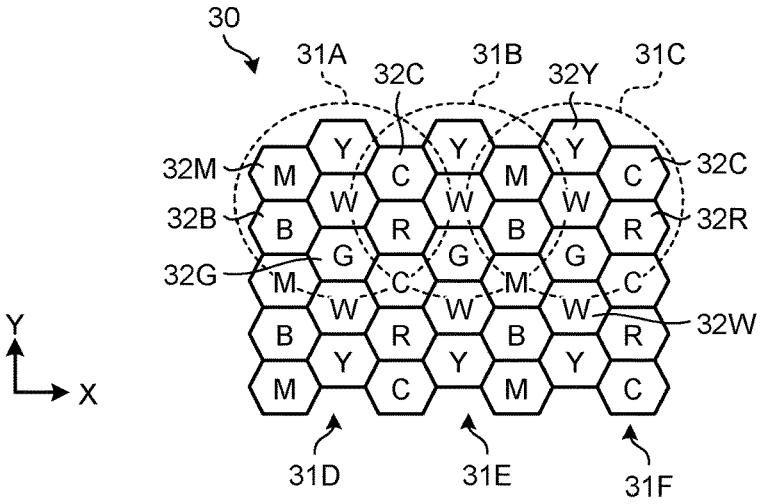
FIG. 14C is a diagram illustrating an arrangement of the sub-pixels in the image display unit according to the second embodiment.

FIG. 14A through FIG. 14C are diagrams illustrating arrangements of the sub-pixels 32 of the image display unit 30 according to the present embodiment. As illustrated in FIG. 14A through FIG. 14C, in the present embodiment, in the image display unit 30, the fourth sub-pixels 32W belonging to the respective pixels 31 are arranged in a two-dimensional matrix in accordance with certain resolution. In the examples illustrated in FIG. 14A through FIG. 14C, the fourth sub-pixel 32W belonging to the first pixel 31A, the fourth sub-pixel 32W belonging to the second pixel 31B, the fourth sub-pixel 32W belonging to the third pixel 31C, the fourth sub-pixel 32W belonging to the fourth pixel 31D, the fourth sub-pixel 32W belonging to the fifth pixel 31E, the fourth sub-pixel 32W belonging to the sixth pixel 31F, the fourth sub-pixel 32W belonging to the seventh pixel 31G, and the fourth sub-pixel 32W belonging to the eighth pixel 31H are arranged in a two-dimensional matrix in the row direction (X-axial direction) and the column direction (Y-axial direction) of the image display unit 30. At each end in the row direction, a color pixel selected from the first sub-pixel 32R, the second sub-pixel 32G, the third sub-pixel 32B, the fifth sub-pixel 32C, the sixth sub-pixel 32M, and the seventh sub-pixel 32Y other than the fourth sub-pixel 32W is arranged. At each end in the column direction, a color pixel selected from the first sub-pixel 32R, the second sub-pixel 32G, the third sub-pixel 32B, the fifth sub-pixel 32C, the sixth sub-pixel 32M, and the seventh sub-pixel 32Y other than the fourth sub-pixel 32W is arranged. In other words, in this image display unit 30, surrounding sub-pixels 32 are arranged at both ends in the row direction and the column direction, respectively.

In the image display unit 30, at least one sub-pixel 32 (surrounding sub-pixel) among the first sub-pixel 32R, the second sub-pixel 32G, the third sub-pixel 32B, the fifth sub-pixel 32C, the sixth sub-pixel 32M, and the seventh sub-pixel 32Y is arranged around the fourth sub-pixel 32W so as to be shared with the adjacent pixel 31. In the examples illustrated in FIG. 14A through FIG. 14C, a TFT substrate may be formed in a hexagonal grid shape, whereas the light-emitting layer may be formed in a square grid shape; the TFT substrate may be provided in a square grid shape, whereas the light-emitting layer may be formed in a substantially hexagonal shape. The light-emitting layer may also be circular.

The following describes an arrangement of the pixels 31 of the image display unit 30 in detail. The image display unit 30 illustrated in FIG. 14A is an example in which the sub-pixel 32 of a primary color component and the sub-pixel 32 of a complementary color component are diagonally arranged. In each of the first pixel 31A, the second pixel 31B, the third pixel 31C, the fourth pixel 31D, the fifth pixel 31E, and the sixth pixel 31F, the first sub-pixel 32R and the fifth sub-pixel 32C are oppositely arranged across the fourth sub-pixel, the second sub-pixel 32G and the sixth sub-pixel 32M are oppositely arranged across the fourth sub-pixel, and the third sub-pixel 32B and the seventh sub-pixel 32Y are oppositely arranged across the fourth sub-pixel. With this arrangement, the center of gravity of luminance becomes less likely to change, and image quality can be improved.

The first pixel 31A shares the third sub-pixel 32B and the sixth sub-pixel 32M with the second pixel 31B adjacent to the right side of the first pixel 31A. The third sub-pixel 32B and the sixth sub-pixel 32M arranged at the column next to the fourth sub-pixel 32W belonging to the first pixel 31A also belong to the second pixel 31B. The first pixel 31A shares the fifth sub-pixel 32C with the fourth pixel 31D adjacent to the lower side of the first pixel 31A. The fifth sub-pixel 32C arranged at the row next to the fourth sub-pixel 32W belonging to the first pixel 31A also belongs to the fourth pixel 31D. Similarly, the second pixel 31B shares the second sub-pixel 32G and the seventh sub-pixel 32Y with the third pixel 31C adjacent to the right side of the second pixel 31B. The second pixel 31B shares the fifth sub-pixel 32C with the fifth pixel 31E adjacent to the lower side of the second pixel 31B. The third pixel 31C shares the fifth sub-pixel 32C with the sixth pixel 31F adjacent to the lower side of the third pixel 31C. The fourth pixel 31D shares the third sub-pixel 32B and the sixth sub-pixel 32M with the fifth pixel 31E adjacent to the right side of the fourth pixel 31D. The fifth pixel 31E shares the second sub-pixel 32G and the seventh sub-pixel 32Y with the sixth pixel 31F adjacent to the right side of the fifth pixel 31E. Although the above embodiment describes an example in which the adjacent pixels 31 share three sub-pixels 32, the number of the sub-pixels 32 shared with the adjacent pixels 31 may be at least one.

The image display unit 30 illustrated in FIG. 14B is an example in which the sub-pixels 32 are arranged in a zigzag grid shape. The first pixel 31A, the second pixel 31B, the third pixel 31C, the fourth pixel 31D, the fifth pixel 31E, and the sixth pixel 31F are arranged such that the first sub-pixel 32R, the second sub-pixel 32G, the third sub-pixel 32B, the fifth sub-pixel 32C, the sixth sub-pixel 32M, and the seventh sub-pixel 32Y are dispersed substantially equally. With this arrangement, the dispersability of the respective colors increases, and image luster increases.

The first pixel 31A shares the third sub-pixel 32B and the sixth sub-pixel 32M with the second pixel 31B adjacent to the right side of the first pixel 31A. The third sub-pixel 32B and the sixth sub-pixel 32M arranged at the column next to the fourth sub-pixel 32W belonging to the first pixel 31A also belong to the second pixel 31B. The first pixel 31A shares the fifth sub-pixel 32C with the fourth pixel 31D adjacent to the lower side of the first pixel 31A. The fifth sub-pixel 32C arranged at the row next to the fourth sub-pixel 32W belonging to the first pixel 31A also belongs to the fourth pixel 31D. Similarly, the second pixel 31B shares the second sub-pixel 32G and the seventh sub-pixel 32Y with the third pixel 31C adjacent to the right side of the second pixel 31B. The second pixel 31B shares the first sub-pixel 32R with the fifth pixel 31E adjacent to the lower side of the second pixel 31B. The third pixel 31C shares the fifth sub-pixel 32C with the sixth pixel 31F adjacent to the lower side of the third pixel 31C. The fourth pixel 31D shares the second sub-pixel 32G and the seventh sub-pixel 32Y with the fifth pixel 31E adjacent to the right side of the fourth pixel 31D. The fifth pixel 31E shares the third sub-pixel 32B and the sixth sub-pixel 32M with the sixth pixel 31F adjacent to the right side of the fifth pixel 31E. Although the above embodiment describes an example in which the adjacent pixels 31 share three sub-pixels 32, the number of the sub-pixels 32 shared with the adjacent pixels 31 may be at least one.

The image display unit 30 illustrated in FIG. 14C is an example in which the sub-pixel 32 of a primary color component and the sub-pixel 32 of a complementary color component are diagonally arranged. In each of the first pixel 31A, the second pixel 31B, the third pixel 31C, the fourth pixel 31D, the fifth pixel 31E, and the sixth pixel 31F, the first sub-pixel 32R and the fifth sub-pixel 32C are arranged adjacent to each other, the second sub-pixel 32G and the seventh sub-pixel 32Y are oppositely arranged across the fourth sub-pixel 32W, and the third sub-pixel 32B and the sixth sub-pixel 32M are arranged adjacent to each other. With this arrangement, the center of gravity of luminance becomes less likely to change, and image quality can be improved.

The first pixel 31A shares the first sub-pixel 32R and the fifth sub-pixel 32C with the second pixel 31B adjacent to the right side of the first pixel 31A. The first sub-pixel 32R and the fifth sub-pixel 32C arranged at the column next to the fourth sub-pixel 32W belonging to the first pixel 31A also belong to the second pixel 31B. The first pixel 31A shares the second sub-pixel 32G with the fourth pixel 31D adjacent to the lower side of the first pixel 31A. The second sub-pixel 32G arranged at the row next to the fourth sub-pixel 32W belonging to the first pixel 31A also belongs to the fourth pixel 31D. Similarly, the second pixel 31B shares the third sub-pixel 32B and the sixth sub-pixel 32M with the third pixel 31C adjacent to the right side of the second pixel 31B. The second pixel 31B shares the second sub-pixel 32G with the fifth pixel 31E adjacent to the lower side of the second pixel 31B. The third pixel 31C shares the second sub-pixel 32G with the sixth pixel 31F adjacent to the lower side of the third pixel 31C. The fourth pixel 31D shares the first sub-pixel 32R and the fifth sub-pixel 32C with the fifth pixel 31E adjacent to the right side of the fourth pixel 31D. The fifth pixel 31E shares the third sub-pixel 32B and the sixth sub-pixel 32M with the sixth pixel 31F adjacent to the right side of the fifth pixel 31E. Although the above embodiment describes an example in which the adjacent pixels 31 share three sub-pixels 32, the number of the sub-pixels 32 shared with the adjacent pixels 31 may be at least one.

As described above, the present embodiment also arranges the fourth sub-pixels 32W of the white component in a two-dimensional matrix in accordance with desired resolution. Therefore, even when the sub-pixels 32 other than the fourth sub-pixels 32W are arranged with half the desired resolution, colors according to the input image signal can be reproduced, and deterioration of image quality can be reduced. Part of the red (R) component, the green (G) component, and the blue (B) component is successively replaced with the white (W) component, the cyan (C) component, and the yellow (Y) component to be output. Therefore, even when a luminance attenuation rate decreases as saturation decreases, the ratio that can be replaced with the white component increases, and power consumption can favorably be reduced.

APPLICATION EXAMPLES

The following describes application examples of the present disclosure in which the display device 10 described above is applied to electronic apparatuses.

FIGS. 15 to 25 are diagrams illustrating examples of an electronic apparatus including the display device according to the embodiment. The display device 10 according to the embodiment can be applied to electronic apparatuses in various fields such as a television apparatus, a digital camera, a notebook-type personal computer, a portable electronic apparatus such as a cellular telephone, or a video camera. In other words, the display device 10 can be applied to electronic apparatuses in various fields that display a video signal input from the outside or a video signal generated inside as an image or a video.

Application Example 1

Figure 15:
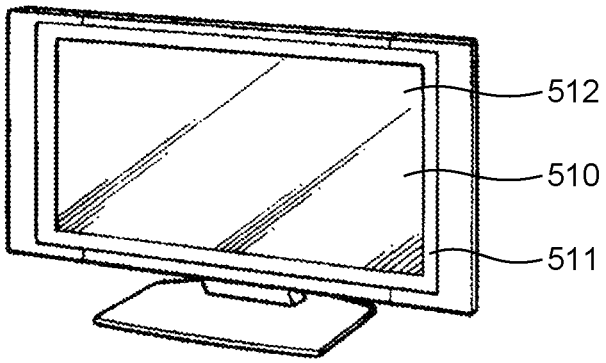
FIG. 15 is a diagram illustrating an example of an electronic apparatus including the display device according to the present embodiment.

The electronic apparatus illustrated in FIG. 15 is a television apparatus to which the display device 10 is applied. The television apparatus includes, for example, a video display screen unit 510 including a front panel 511 and a filter glass 512, and the display device 10 is applied to the video display screen unit 510. That is, the screen of the television apparatus may have a function of detecting a touch operation in addition to a function of displaying an image.

Application Example 2

Figure 16:
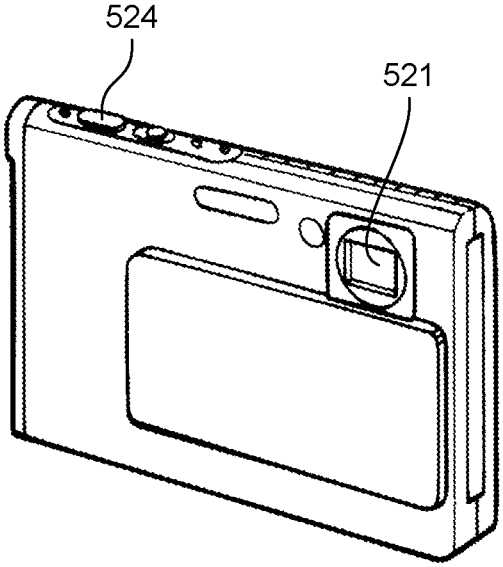
FIG. 16 is a diagram illustrating an example of the electronic apparatus including the display device according to the present embodiment.
Figure 17:
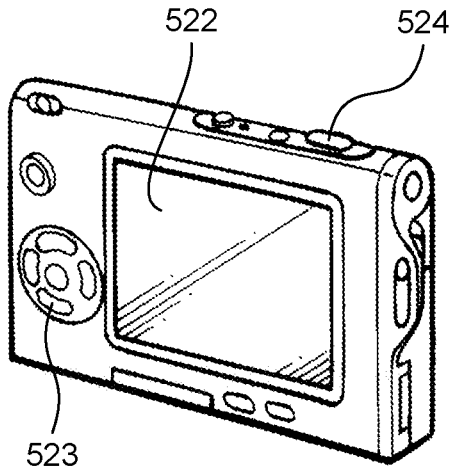
FIG. 17 is a diagram illustrating an example of the electronic apparatus including the display device according to the present embodiment.

The electronic apparatus illustrated in FIGS. 16 and 17 is a digital camera to which the display device 10 is applied. The digital camera includes, for example, a flash light-emitting unit 521, a display unit 522, a menu switch 523, and a shutter button 524, and the display device 10 is applied to the display unit 522. Accordingly, the display unit 522 of the digital camera may have the function of detecting a touch operation in addition to the function of displaying an image.

Application Example 3

Figure 18:
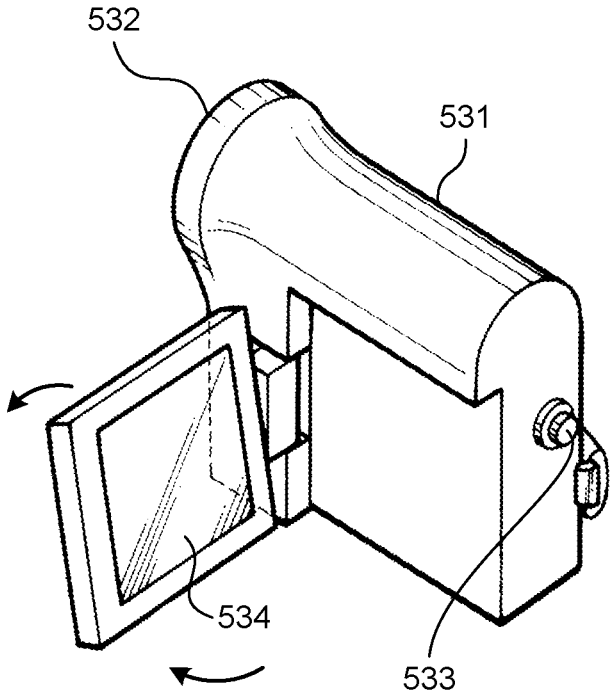
FIG. 18 is a diagram illustrating an example of the electronic apparatus including the display device according to the present embodiment.

The electronic apparatus illustrated in FIG. 18 is an external appearance of a video camera to which the display device 10 is applied. The video camera includes, for example, a main body part 531, a lens 532 for photographing a subject arranged on a front side surface of the main body part 531, a start/stop switch 533 for photographing, and a display unit 534. The display device 10 is applied to the display unit 534. Accordingly, the display unit 534 of the video camera may have the function of detecting a touch operation in addition to the function of displaying an image.

Application Example 4

Figure 19:
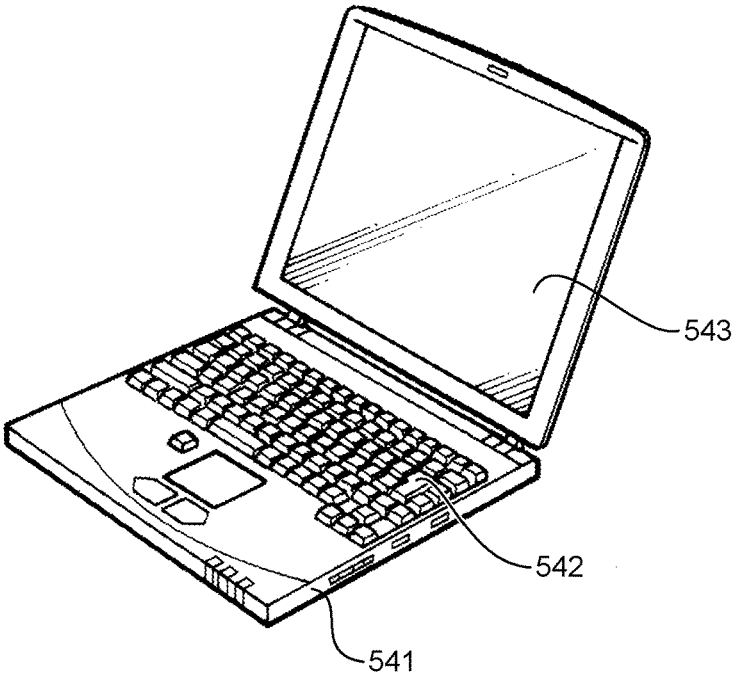
FIG. 19 is a diagram illustrating an example of the electronic apparatus including the display device according to the present embodiment.

The electronic apparatus illustrated in FIG. 19 is a notebook-type personal computer to which the display device 10 is applied. The notebook-type personal computer includes, for example, a main body 541, a keyboard 542 for inputting characters and the like, and a display unit 543 that displays an image. The display device 10 is applied to the display unit 543. Accordingly, the display unit 543 of the notebook-type personal computer may have the function of detecting a touch operation in addition to the function of displaying an image.

Application Example 5

Figure 20:
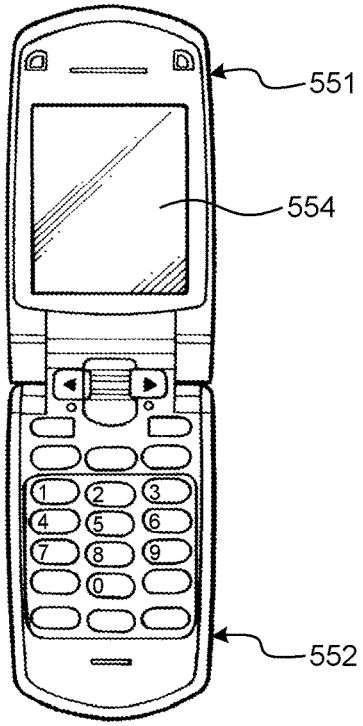
FIG. 20 is a diagram illustrating an example of the electronic apparatus including the display device according to the present embodiment.
Figure 21:
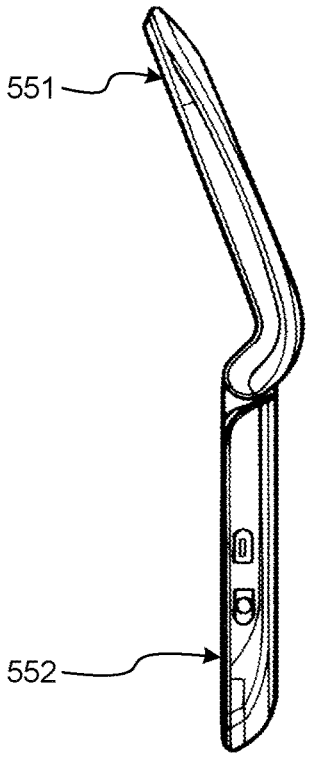
FIG. 21 is a diagram illustrating an example of the electronic apparatus including the display device according to the present embodiment.
Figure 22:
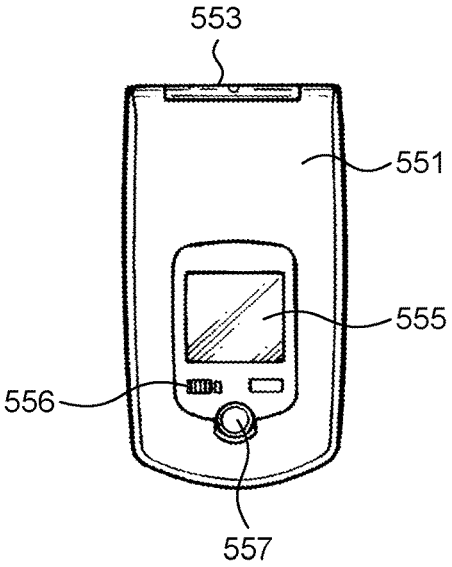
FIG. 22 is a diagram illustrating an example of the electronic apparatus including the display device according to the present embodiment.

The electronic apparatus illustrated in FIGS. 20 to 22 is a cellular telephone to which the display device 10 is applied. The cellular telephone is composed of an upper housing 551 and a lower housing 552 connected together by a connecting part (hinge part) 553, for example, and includes a display device 554, a sub-display device 555, a picture light 556, and a camera 557. The display device 10 is mounted as the display device 554. Accordingly, the display device 554 of the mobile phone may have the function of detecting a touch operation in addition to the function of displaying an image.

Application Example 6

Figure 23:
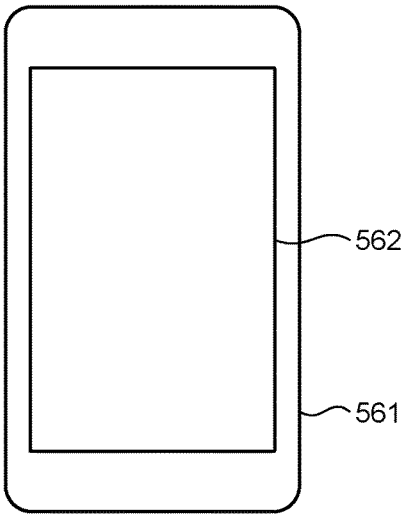
FIG. 23 is a diagram illustrating an example of the electronic apparatus including the display device according to the present embodiment.

The electronic apparatus illustrated in FIG. 23 is an information portable terminal that operates as a portable computer, a multifunctional mobile phone, a mobile computer allowing a voice communication, or a communicable mobile computer, what is called a smartphone or a tablet terminal. The information portable terminal includes a display unit 562 on a surface of a housing 561, for example. The display device 10 is mounted as the display unit 562. The display unit 562 may have the function of detecting a touch operation in addition to the function of displaying an image.

Application Example 7

Figure 24:
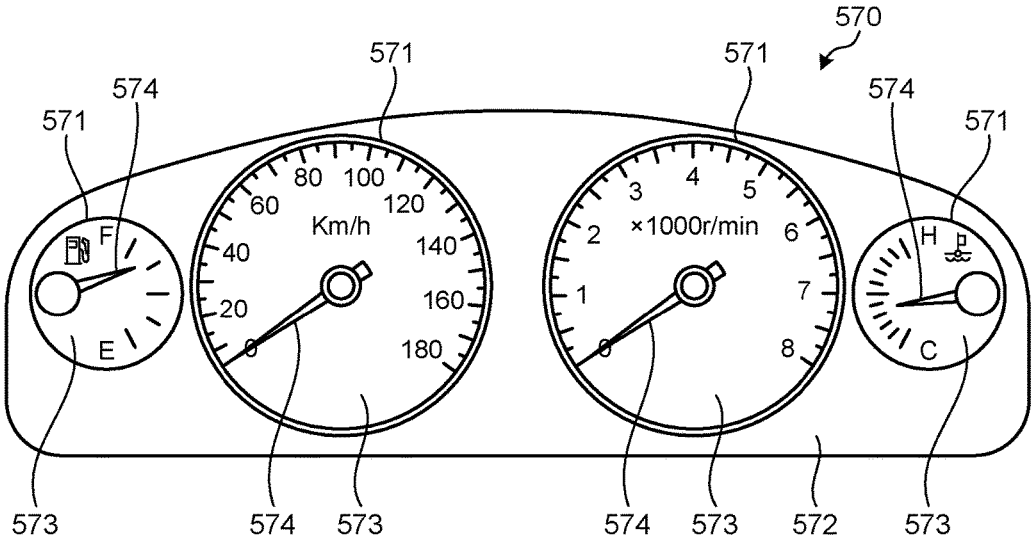
FIG. 24 is a diagram illustrating an example of the electronic apparatus including the display device according to the present embodiment.

FIG. 24 is a schematic configuration diagram of a meter unit according to the present embodiment. The electronic apparatus illustrated in FIG. 24 is a meter unit installed in vehicles. This meter unit (electronic apparatus) 570 includes a plurality of display devices 10 according to the present embodiment such as a fuel gauge, a water-temperature gauge, a speedometer, and a tachometer as display devices 571. The display devices 571 are collectively covered with a single exterior panel 572.

Each of the display devices 571 has a configuration in which a panel 573 as display means and a movement mechanism as analog display means are combined with each other. The movement mechanism includes a motor as drive means and a pointer 574 rotated by the motor. Each of the display devices 571 can display scale display, warning display, and the like on a display face of the panel 573 and rotate the pointer 574 of the movement mechanism on the displace face side of the panel 573.

Although the display devices 571 are provided inside the single exterior panel 572 in FIG. 24, this is not limiting. One display device 571 may be provided in an area surrounded by the exterior panel 572, and the display device may display the fuel gauge, the water-temperature gauge, the speedometer, the tachometer, and the like.

The present disclosure can employ the following aspects.

(1) A display device comprising:

an image display unit in which pixels are arranged, each of the pixels including a fourth sub-pixel and surrounding sub-pixels arranged around the fourth sub-pixel, the fourth sub-pixels of the respective pixels being arranged in a two-dimensional matrix and displaying a white color component as a fourth color, each of the pixels sharing at least one of the surrounding sub-pixels with an adjacent pixel adjacent to the pixel; and a signal processing unit that, based on a first input video signal for a specific pixel and a second input video signal for an adjacent pixel adjacent to the specific pixel, generates an output signal for the surrounding sub-pixels belonging to the specific pixel and outputs the generated output signal to the image display unit.

(2) The display device according to (1), wherein the signal processing unit generates third color information on the surrounding sub-pixels belonging to the specific pixel based on second color information obtained by subtracting color information on the fourth sub-pixel belonging to the specific pixel from first color information of the first input video signal for the specific pixel, corrects the third color information on the surrounding sub-pixels belonging to the specific pixel based on third color information on the surrounding sub-pixels belonging to the adjacent pixel generated based on second color information obtained by subtracting color information on the fourth sub-pixel belonging to the adjacent pixel from first color information of the second input video signal for the adjacent pixel to generate an output signal for the surrounding sub-pixels.

(3) The display device according to (2), wherein the signal processing unit subtracts color information on complementary color components with respect to primary color components of the surrounding sub-pixels from the second color information to generate third color information containing color information on the primary color components of the surrounding sub-pixels.

(4) The display device according to (2), wherein the signal processing unit subtracts an output signal of primary color components of the surrounding sub-pixels from the second color information to generate the third color information containing color information on complementary color components with respect to the primary color components of the surrounding sub-pixels.

(5) The display device according to (2), wherein the signal processing unit changes a ratio of the third color information on the specific pixel to the third color information on the adjacent pixel to correct the third color information on the specific pixel.

(6) The display device according to (1), wherein the surrounding sub-pixels include a first sub-pixel displaying a first primary color, a second sub-pixel displaying a second primary color, a third sub-pixel displaying a third primary color, a fifth sub-pixel displaying a first complementary color as a complementary color of the first primary color, a sixth sub-pixel displaying a second complementary color as a complementary color of the second primary color, and a seventh sub-pixel displaying a third complementary color as a complementary color of the third primary color all of which are arranged around the corresponding fourth sub-pixel.

(7) The display device according to claim (6), wherein the surrounding sub-pixels include a pair of the fifth sub-pixels and a pair of the seventh sub-pixels, and the pair of the fifth sub-pixels and the pair of the seventh sub-pixels are arranged around the fourth sub-pixel and at four corners.

(8) A display device comprising an image display unit in which pixels are arranged, wherein each of the pixels includes a fourth sub-pixel and eight surrounding sub-pixels arranged in a square grid shape of three rows and three columns, the surrounding sub-pixels being arranged around the fourth sub-pixel, the fourth sub-pixels of the respective pixels are arranged in a two-dimensional matrix and display a white component as a fourth color, and each of the pixels shares at least one of the surrounding sub-pixels with an adjacent pixel adjacent to the pixel.

(9) The display device according to (8), wherein each of the pixels shares three surrounding sub-pixels arranged on the right side of the fourth sub-pixel belonging to the pixel with an adjacent pixel arranged adjacent to the right side thereof, each of the pixels shares three surrounding sub-pixels arranged on the left side of the fourth sub-pixel with an adjacent pixel arranged adjacent to the left side thereof, each of the pixels shares three surrounding sub-pixels arranged on the upper side of the fourth sub-pixel with an adjacent pixel arranged adjacent to the upper side thereof, and each of the pixels shares three surrounding sub-pixels arranged on the lower side of the fourth sub-pixel with an adjacent pixel arranged adjacent to the lower side thereof.

(10) The display device according to (8) or (9), wherein the surrounding sub-pixels include a first sub-pixel displaying a first primary color arranged around the corresponding fourth sub-pixel, a second sub-pixel displaying a second primary color, a third sub-pixel displaying a third primary color, a fifth sub-pixel displaying a first complementary color as a complementary color of the first primary color, a sixth sub-pixel displaying a second complementary color as a complementary color of the second primary color, and a seventh sub-pixel displaying a third complementary color as a complementary color of the third primary color all of which are arranged around the fourth sub-pixel.

(11) The display device according to (10), wherein the surrounding sub-pixels include a pair of the fifth sub-pixels and a pair of the seventh sub-pixels, and the pair of the fifth sub-pixels and the pair of the seventh sub-pixels are arranged around the fourth sub-pixel and at four corners.

(12) A display device comprising an image display unit in which pixels are arranged, wherein each of the pixels includes a fourth sub-pixel and at least three surrounding sub-pixels arranged around the fourth sub-pixel and at positions distances from the fourth sub-pixel of which are substantially equal, the fourth sub-pixels of the respective pixels are arranged in a two-dimensional matrix and display a white component as a fourth color, and each of the pixels shares at least one of the surrounding sub-pixels with an adjacent pixel adjacent to the pixel.

(13) The display device according to (12), wherein the fourth sub-pixel and the surrounding sub-pixels are arranged in a hexagonal grid shape, and the surrounding sub-pixels include seven surrounding sub-pixels.

(14) The display device according to (13), wherein each of the pixels shares at least one of the surrounding sub-pixels arranged on the right side of the fourth sub-pixel belonging to the pixel with an adjacent pixel arranged adjacent to the right side thereof, each of the pixels shares at least one of the surrounding sub-pixels arranged on the left side of the fourth sub-pixel with an adjacent pixel arranged adjacent to the left side thereof, each of the pixels shares at least one of the surrounding sub-pixels arranged on the upper side of the fourth sub-pixel with an adjacent pixel arranged adjacent to the upper side thereof, and each of the pixels shares at least one of the surrounding sub-pixels arranged on the lower side of the fourth sub-pixel with an adjacent pixel arranged adjacent to the lower side thereof.

(15) The display device according to (12), wherein the surrounding sub-pixels include a first sub-pixel displaying a first primary color, a second sub-pixel displaying a second primary color, a third sub-pixel displaying a third primary color, a fifth sub-pixel displaying a first complementary color as a complementary color of the first primary color, a sixth sub-pixel displaying a second complementary color as a complementary color of the second primary color, and a seventh sub-pixel displaying a third complementary color as a complementary color of the third primary color all of which are arranged around the corresponding fourth sub-pixel.

(16) The display device according to (8) or (12), further comprising a signal processing unit that, based on a first input video signal for a specific pixel and a second input video signal for an adjacent pixel adjacent to the specific pixel, generates an output signal for the surrounding sub-pixels belonging to the specific pixel and outputs the generated output signal to the image display unit, wherein the signal processing unit generates third color information on the surrounding sub-pixels belonging to the specific pixel based on second color information obtained by subtracting color information on the fourth sub-pixel belonging to the specific pixel from first color information of the first input video signal for the specific pixel, corrects the third color information on the surrounding sub-pixels belonging to the specific pixel based on third color information on the surrounding sub-pixels belonging to the adjacent pixel generated based on second color information obtained by subtracting color information on the fourth sub-pixel belonging to the adjacent pixel from first color information of the second input video signal for the adjacent pixel to generate an output signal for the surrounding sub-pixels.

(17) The display device according to (16), wherein the signal processing unit subtracts color information on complementary color components with respect to primary color components of the surrounding sub-pixels from the second color information to generate the third color information containing color information on the primary color components of the surrounding sub-pixels.

(18) The display device according to (16), wherein the signal processing unit subtracts an output signal of primary color components of the surrounding sub-pixels from the second color information to generate the third color information containing color information on complementary color components with respect to the primary color components of the surrounding sub-pixels.

(19) The display device according to (16), wherein the signal processing unit changes a ratio of the third color information on the specific pixel to the third color information on the adjacent pixel to correct the third color information on the specific pixel.

(20) The display device according to any one of (6), (10), and (15), wherein in the image display unit, a color pixel selected from the group consisting of the first sub-pixel, the second sub-pixel, the third sub-pixel, the fifth sub-pixel, the sixth sub-pixel, and the seventh sub-pixel is arranged at each end in a row direction and each end in a column direction.

What is claimed is:

1. A display device comprising:

an image display unit in which pixels are arranged, each of the pixels including a fourth sub-pixel and surrounding sub-pixels arranged around the fourth sub-pixel, the fourth sub-pixels of the respective pixels being arranged in a column-row configuration and displaying a white color component;

a signal processing unit that, based on a surrounding sub-pixels signal including a first input video signal for a pixel and a second input video signal for an adjacent pixel adjacent to the pixel, generates an output signal for the surrounding sub-pixels belonging to the pixel and outputs the generated output signal to the image display unit, wherein the surrounding sub-pixels include at least one pair of a same color sub-pixel, the at least one pair of the same color sub-pixel are arranged away from each other through an intermediary of sub-pixels in other colors; and a surrounding sub-pixel is arranged between the fourth sub-pixel of the pixel and the fourth sub-pixel of the adjacent pixel, the surrounding sub-pixel is shared between the pixel and the adjacent pixel, when a first output signal for the pixel includes an output signal for the surrounding sub-pixel is output to the image display unit, the surrounding sub-pixel turns on, and when a second output signal for the adjacent pixel includes an output signal for the surrounding sub-pixel is output to the image display unit, the surrounding sub-pixel turns on.

2. The display device according to claim 1, wherein the surrounding sub-pixels include at least two pairs of a same color sub-pixels.

3. The display device according to claim 1, wherein the at least one pair of the same color sub-pixel are arranged across the fourth sub-pixel.

4. The display device according to claim 1, wherein the surrounding sub-pixels include a first sub-pixel displaying a first primary color, a second sub-pixel displaying a second primary color, a third sub-pixel displaying a third primary color, a fifth sub-pixel displaying a first complementary color of the first primary color, a sixth sub-pixel displaying a second complementary color of the second primary color, and a seventh sub-pixel displaying a third complementary color of the third primary color and the at least one pair of the same color sub-pixel include at least one sub-pixel selected from a group consisting of:

the fifth sub-pixel, the sixth sub-pixel, and the seventh sub-pixel.

5. The display device according to claim 4, wherein the at least one pair of the same color sub-pixel include at least one of the fifth sub-pixel and the seventh sub-pixel.

6. The display device according to claim 1, wherein the surrounding sub-pixels are shared among the pixel and the adjacent pixel that is adjacent to the pixel.

7. The display device according to claim 6, wherein the surrounding sub-pixels are arranged between the fourth sub-pixel of the pixel and the fourth sub-pixel of the adjacent pixel and the surrounding sub-pixels are shared among the pixel and the adjacent pixel.

8. A display device comprising:

an image display unit in which pixels are arranged, each of the pixels including a fourth sub-pixel and surrounding sub-pixels arranged around the fourth sub-pixel, the fourth sub-pixels of the respective pixels being arranged in a column-row configuration and displaying a white color component; and a signal processing unit that, based on a surrounding sub-pixels signal including a first input video signal for a pixel and a second input video signal for an adjacent pixel adjacent to the pixel, generates an output signal for the surrounding sub-pixels belonging to the pixel and outputs the generated output signal to the image display unit, wherein the surrounding sub-pixels include at least one pair of a same color sub-pixel, the at least one pair of the same color sub-pixel are arranged away from each other through an intermediary of sub-pixels in other colors, the surrounding sub-pixels include a first sub-pixel displaying a first primary color, a second sub-pixel displaying a second primary color, a third sub-pixel displaying a third primary color, a fifth sub-pixel displaying a first complementary color of the first primary color, a sixth sub-pixel displaying a second complementary color of the second primary color, and a seventh sub-pixel displaying a third complementary color of the third primary color and the at least one pair of the same color sub-pixel include at least one sub-pixel selected from a group consisting of:

the fifth sub-pixel, the sixth sub-pixel, and the seventh sub-pixel.

9. The display device according to claim 8, wherein the surrounding sub-pixels include at least two pairs of a same color sub-pixels.

10. The display device according to claim 8, wherein the at least one pair of the same color sub-pixel are arranged across the fourth sub-pixel.

11. The display device according to claim 8, wherein the at least one pair of the same color sub-pixel include at least one of the fifth sub-pixel and the seventh sub-pixel.

12. The display device according to claim 8, wherein the surrounding sub-pixels are shared among the pixel and the adjacent pixel that is adjacent to the pixel.

13. The display device according to claim 12, wherein the surrounding sub-pixels are arranged between the fourth sub-pixel of the pixel and the fourth sub-pixel of the adjacent pixel and the surrounding sub-pixels are shared among the pixel and the adjacent pixel.

14. The display device according to claim 8, further comprising:

a surrounding sub-pixel is arranged between the fourth sub-pixel of the pixel and the fourth sub-pixel of the adjacent pixel, the surrounding sub-pixel is shared between the pixel and the adjacent pixel, when a first output signal for the pixel includes an output signal for the surrounding sub-pixel is output to the image display unit, the surrounding sub-pixel turns on, and when a second output signal for the adjacent pixel includes an output signal for the surrounding sub-pixel is output to the image display unit, the surrounding sub-pixel turns on.

* * * * *